US012703530B1

(12) United States Patent
Burright et al.

(10) Patent No.: US 12,703,530 B1
(45) Date of Patent: Aug. 11, 2026

(54) DEVICE FOR EXPANDING CONTAINER TO BE LOADED WITH ITEM(S)

(71) Applicant: Amazon Technologies, Inc., Seattle, WA (US)

(72) Inventors: Joshua Arleigh Burright, Shoreline, WA (US); Frank Van Yperzele, Wichelen (BE); Jente De Maeyer, Londerzeel (BE); Jerrold Allen Beckmann, North Bend, WA (US)

(73) Assignee: Amazon Technologies, Inc., Seattle, WA (US)

( * ) Notice: Subject to any disclaimer, the term of this patent is extended or adjusted under 35 U.S.C. 154(b) by 46 days.

(21) Appl. No.: 18/827,188

(22) Filed: Sep. 6, 2024

(51) Int. Cl.
*B65B 43/54* (2006.01)
*B65B 43/36* (2006.01)
*B65B 57/04* (2006.01)

(52) U.S. Cl.
CPC ..... *B65B 43/54* (2013.01); *B65B 43/36* (2013.01); *B65B 57/04* (2013.01)

(58) Field of Classification Search
CPC ..... B65B 43/54; B65B 43/36; B65B 57/04; B43M 3/00; B43M 3/02; B43M 3/04; B43M 3/045
USPC ..... 53/473, 569, 284.3, 381.5, 381.6, 381.7
See application file for complete search history.

(56) References Cited

U.S. PATENT DOCUMENTS 3,579,948 A * 5/1971 Lerner ..... B65B 43/30 53/385.1
3,667,189 A * 6/1972 Blossom ..... B43M 3/045 53/457
3,868,807 A * 3/1975 Noyes ..... B65B 57/10 53/74
3,886,715 A * 6/1975 Dorer ..... B43M 3/04 53/284.3
3,910,007 A * 10/1975 Dorer ..... B43M 3/045 53/569
4,379,384 A * 4/1983 Nishikawa ..... B65B 25/20 53/569
4,393,640 A * 7/1983 Cole ..... B65B 43/123 53/391
4,674,258 A * 6/1987 Ehlscheid ..... B43M 3/045 53/284.3
4,875,668 A * 10/1989 Spyra ..... B42C 3/00 270/32
4,928,829 A * 5/1990 Di Bernardo ..... B65B 31/06 383/68
5,042,232 A * 8/1991 Orsinger ..... B43M 3/045 53/284.3
5,081,825 A * 1/1992 Mrozinski ..... B43M 3/045 53/284.3
5,127,640 A * 7/1992 Orsinger ..... B43M 3/045 270/58.06

(Continued)

*Primary Examiner* — Dariush Seif
(74) *Attorney, Agent, or Firm* — Eversheds Sutherland (US) LLP

(57) ABSTRACT

A device includes a platform configured to receive a plurality of containers, a fan, a manifold, and a biasing element. The manifold is fluidly connected to the fan and directs air into a container of the plurality of containers. Directing air into the container causes the container to at least partially expand to permit the container to be loaded with one or more items. The biasing element biases the platform in a direction toward the air being directed into the container.

19 Claims, 19 Drawing Sheets

(56) References Cited

U.S. PATENT DOCUMENTS 5,211,384 A * 5/1993 Orsinger ..... B43M 3/045 53/284.3
5,249,409 A * 10/1993 Jensen ..... B65B 43/26 53/469
5,257,805 A * 11/1993 Belec ..... B43M 3/045 271/107
5,388,388 A * 2/1995 Belec ..... B43M 3/045 53/53
5,511,364 A * 4/1996 Levi ..... B65B 5/067 53/258
5,517,797 A * 5/1996 Ballard ..... B43M 3/045 53/64
5,552,691 A * 9/1996 Pierce ..... G05B 19/416 318/568.11
5,581,972 A * 12/1996 Antonelli ..... H01F 7/1607 53/284.3
5,618,375 A * 4/1997 Suzuki ..... B43M 5/042 53/284.3
5,675,959 A * 10/1997 Hamma ..... B43M 3/045 53/381.1
5,692,364 A * 12/1997 Staniszewski ..... B43M 3/045 53/569
5,722,221 A * 3/1998 Maltman ..... B43M 3/045 53/381.5
5,809,749 A * 9/1998 Ruggiero ..... B43M 3/045 53/381.5
5,832,702 A * 11/1998 Jacobson ..... B43M 3/045 53/284.3
5,876,320 A * 3/1999 LeCompte ..... B65H 45/12 493/395
5,924,265 A * 7/1999 Auerbach ..... B43M 3/045 53/569
5,979,148 A * 11/1999 Baker ..... H04N 1/4446 493/379
6,155,031 A * 12/2000 Ballestrazzi ..... B65H 39/043 53/381.5
6,425,223 B1 * 7/2002 Miller ..... B43M 5/042 53/381.6
6,494,019 B1 * 12/2002 Lingle ..... B43M 3/045 53/284.3
6,718,731 B1 * 4/2004 Werner ..... B43M 3/045 53/284.3
7,181,895 B1 * 2/2007 Rozenfeld ..... B43M 3/045 53/284.3
7,412,809 B2 * 8/2008 Yuyama ..... B65B 5/105 53/284.3
7,600,755 B1 * 10/2009 Rozenfeld ..... B43M 3/04 198/689.1
7,934,356 B2 * 5/2011 Yuyama ..... B65B 5/045 53/247
8,281,919 B2 * 10/2012 Rozenfeld ..... B43M 3/045 271/259
8,453,417 B2 * 6/2013 Oshio ..... B65B 25/14 53/118
2003/0150194 A1 * 8/2003 Ponti ..... B43M 3/045 53/284.3
2004/0123571 A1 * 7/2004 Rozenfeld ..... B43M 3/045 53/569
2005/0034433 A1 * 2/2005 Gomez ..... B43M 3/045 53/569
2005/0039845 A1 * 2/2005 Belt ..... B65B 15/04 156/196
2006/0042196 A1 * 3/2006 Stemmle ..... B65B 43/28 53/381.5
2006/0254223 A1 * 11/2006 Passoni ..... B43M 3/045 53/381.7
2008/0302068 A1 * 12/2008 Ponti ..... B43M 3/045 53/284.3
2009/0288373 A1 * 11/2009 Feijen ..... B43M 3/045 53/284.3
2010/0313530 A1 * 12/2010 Smith ..... B43M 3/045 53/569
2011/0099946 A1 * 5/2011 Fijnvandraat ..... B43M 3/045 53/381.5
2011/0203230 A1 * 8/2011 Heemstra ..... B43M 3/045 53/235
2012/0168280 A1 * 7/2012 Batzer ..... B65B 5/04 198/471.1
2013/0055686 A1 * 3/2013 Batzer ..... B65G 15/58 53/235
2013/0055689 A1 * 3/2013 Hoepner ..... B65B 5/00 53/381.1
2013/0333333 A1 * 12/2013 Batzer ..... B43M 3/045 53/381.5
2014/0096492 A1 * 4/2014 Celeste ..... B43M 3/045 53/284.3
2014/0196414 A1 * 7/2014 Schempp ..... B43M 7/004 53/569
2015/0274338 A1 * 10/2015 Kawano ..... B65B 7/06 53/284.3
2016/0243883 A1 * 8/2016 DePoi ..... B43M 3/045
2018/0272794 A1 * 9/2018 Suga ..... B65H 29/6618
2019/0160856 A1 * 5/2019 Middelberg ..... B43M 3/04
2024/0270424 A1 * 8/2024 Jeong ..... B65B 43/28

* cited by examiner

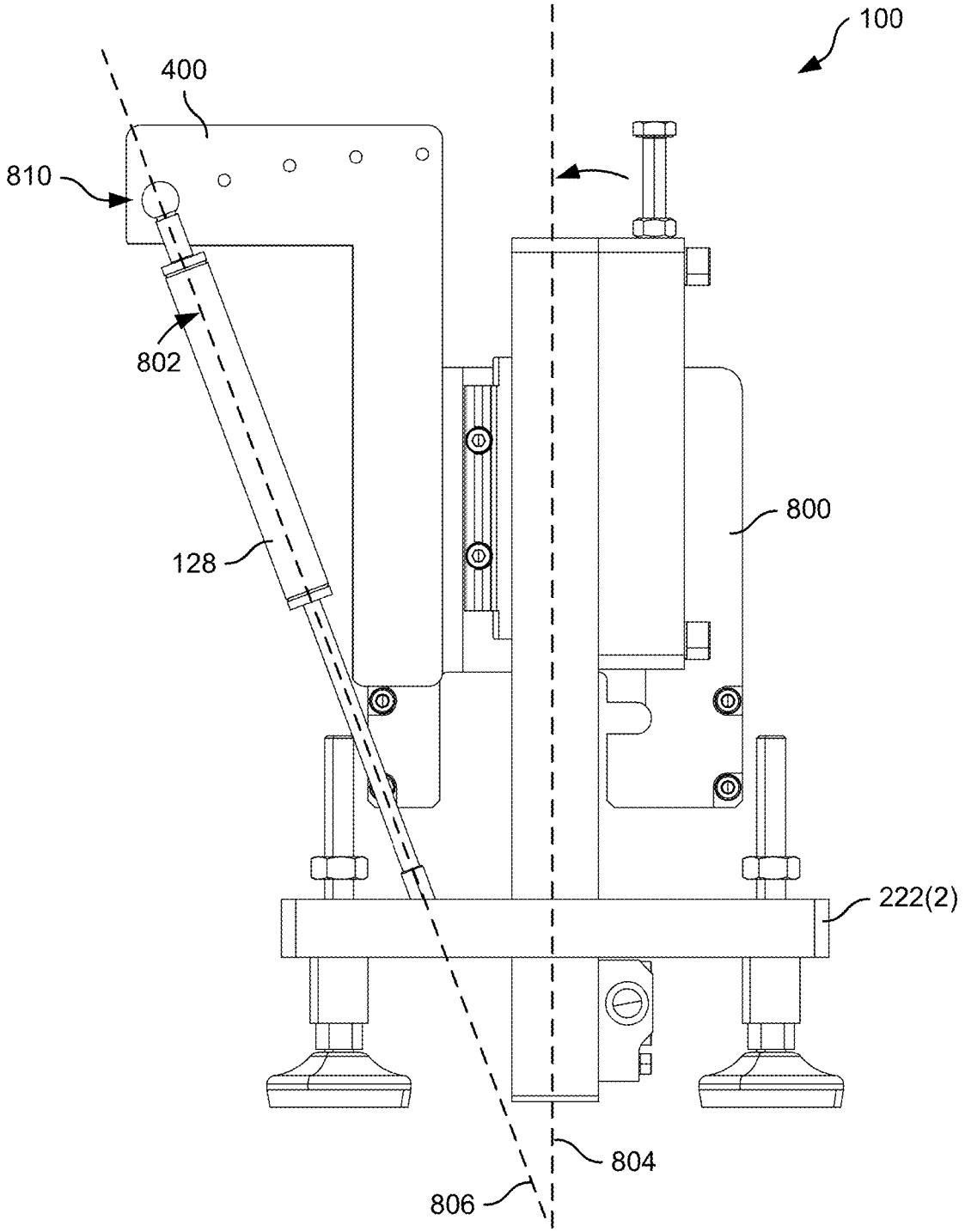
FIG. 8A
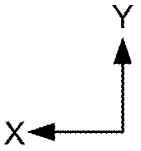

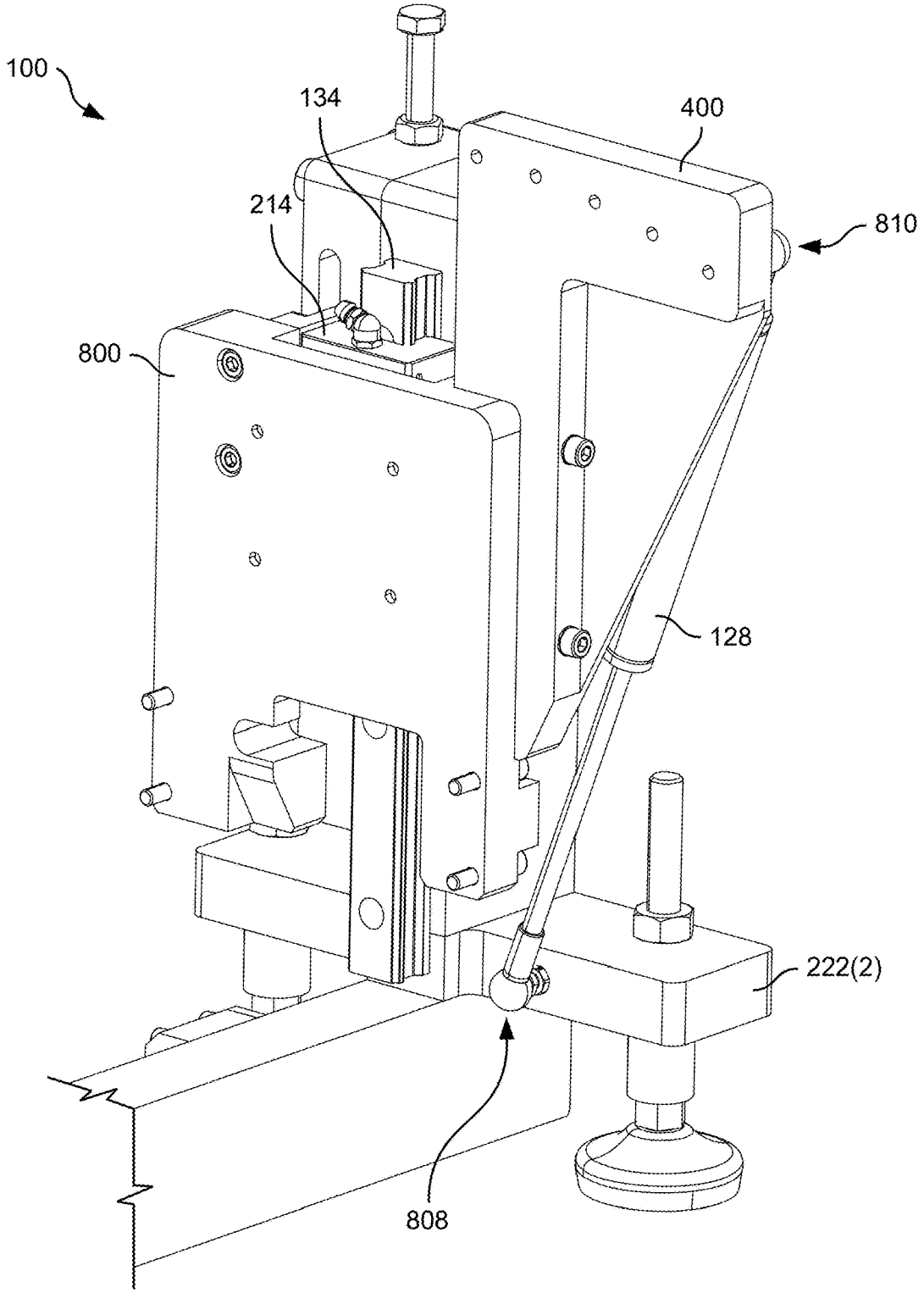
FIG. 8B
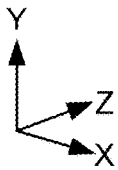

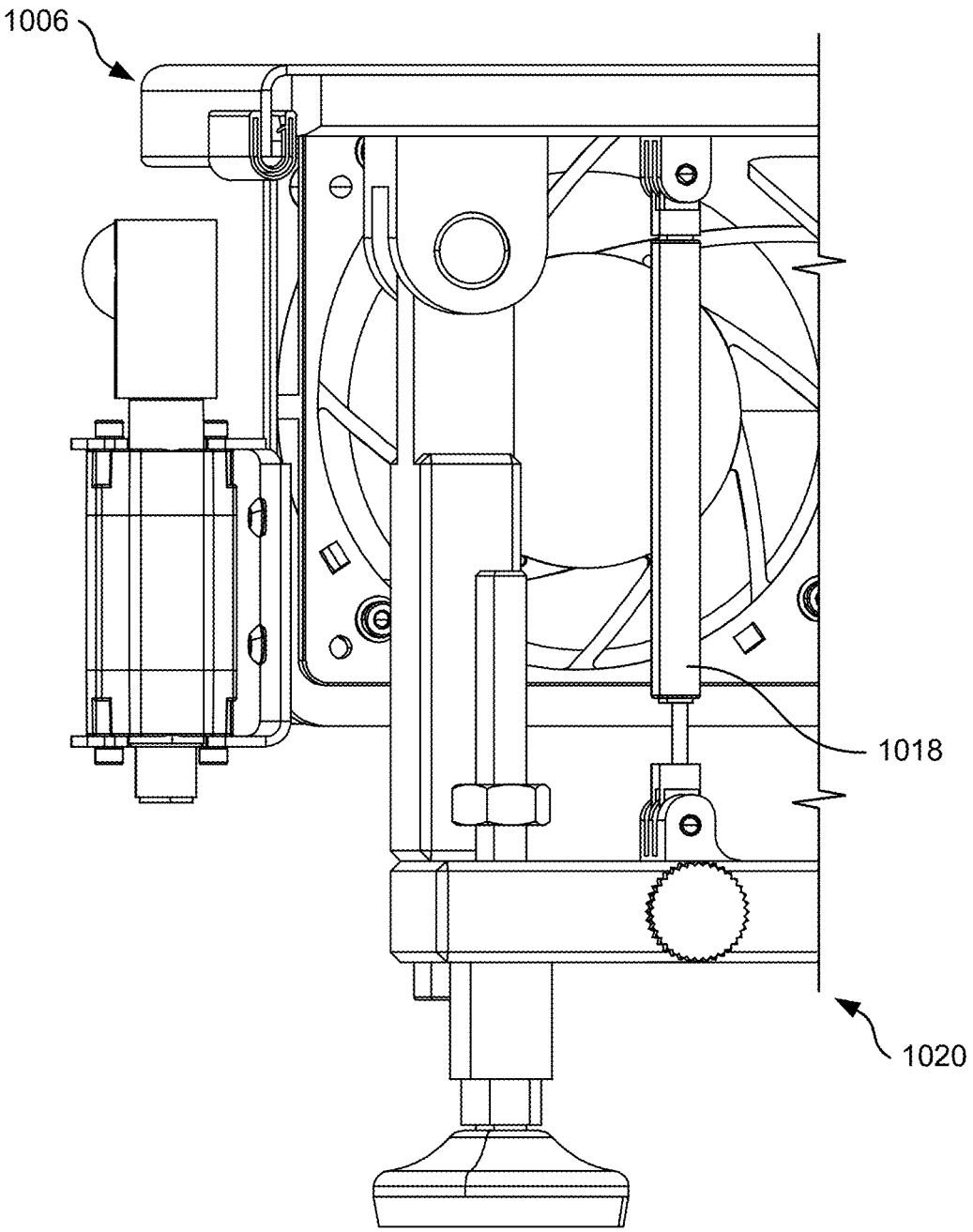
FIG. 10C
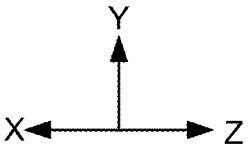

DEVICE FOR EXPANDING CONTAINER TO BE LOADED WITH ITEM(S)

BACKGROUND

Retailers, wholesalers, and other product distributors maintain an inventory of items that may be ordered, leased, rented, and so forth. For example, an e-commerce retailer may maintain inventory in a fulfillment center. The rise of e-commerce has brought about an increase in order fulfillment, packaging, and shipment. Consequently, to meet these demands, retailers, for example, are required to package items at faster rates. However, retailers are not equipped to handle the increased packaging, which may lead to errors, inefficiencies, and the like.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features. The systems depicted in the accompanying figures are not to scale and components within the figures may be depicted not to scale with each other.

FIGS. 8A and 8B illustrate an example biasing element of the device of FIG. 1 that biases the container into position for permitting the container to be expanded, according to examples of the present disclosure.

FIGS. 10A-10C illustrate an alternate device used to expand a container for permitting the container to be conveniently loaded with item(s), according to examples of the present disclosure.

DETAILED DESCRIPTION

Figure 1:
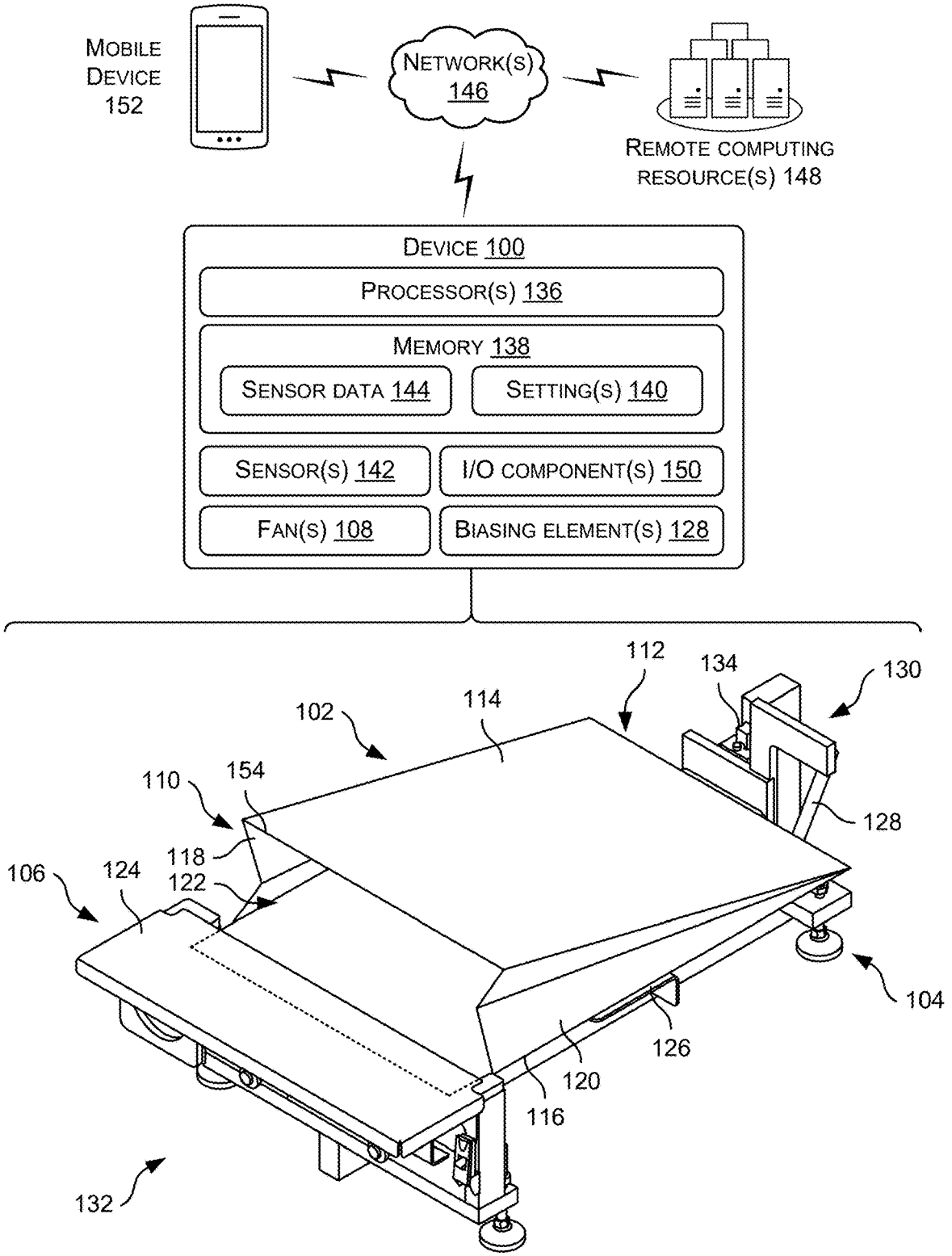
FIG. 1 illustrates an example device used to expand a container to permit the container to be conveniently loaded with item(s), according to examples of the present disclosure.
Figure 1:
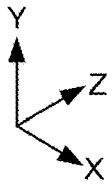

This application is directed, at least in part, to a device that assists in opening a container to permit the container to be conveniently packed or loaded with item(s), according to examples of the present disclosure. In some instances, the device may include fan(s) that blow or otherwise force air into the container to at least partially open, erect, inflate, enlarge, expand, etc., the container. For example, the fan(s) may blow air into a cavity of the container to force the container to expand and enable the item(s) to be loaded within the cavity. The fan(s) may blow air into the container before, during, and/or after loading the item(s). However, after being loaded, the container may be removed from the device and another container may be subsequently expanded and loaded with item(s). In some instances, the device permits personnel to load the item(s) into the container without the need to hold open sides, surfaces, etc. of the container. As such, the device may be used to increase efficiencies and throughput.

In some instances, the device may include a base having a platform and a rail engaged by the platform. The platform may be biased, along the rail, via one or more biasing element(s) (e.g., springs, gas cylinders, etc.). In some instances, the rail may include grooves, channels, etc. that are engaged by corresponding features of the platform. One or more bearings may be disposed between an interface of the rail and the platform to reduce friction.

The platform may receive or be loaded with empty containers, or containers that are to be loaded with the item(s). For example, a magazine, stack, wicket, etc., of empty containers may be loaded onto the platform. The container may represent any suitable container, such as bags, envelopes, bubble mailers, etc. The container may be manufactured from paper-based products or plastic-based products. The container may include a front that is open to receive the item(s) and a back, opposite the front, that is enclosed. Additionally, the container may include sides, such as a top, a bottom, a left or first side, a right or second side, etc. As will be disposed herein, blowing air into the container may cause the top to expand from the bottom, the left side to expand from the right side, etc. to permit the item(s) to be conveniently loaded into the container.

The platform may have a bottom-most position and a top-most position. In the bottom-most position, the device may be loaded with empty containers and hold a maximum number of empty containers, whereas in the top-most position, the device may be emptied of the containers (e.g., all the containers have been filled). The platform may receive any number of containers, such as thirty, one hundred, etc.

A top-most container in the stack of the containers may be expanded. As the containers are loaded and removed from the platform, the biasing elements move the platform along the rail, in a direction from the bottom-most position to the top-most position. As the containers move towards the top-most position, the air is forced into the cavity of the top-most container in order to expand the container and permit the container to be conveniently loaded with the item(s). For example, as a first container is expanded and loaded with first item(s), the first container may be removed from the stack of containers. Once the first container is removed, the biasing element(s) may urge the stack of containers upwards, for example, in a direction towards the fan(s), such that a second container may be expanded and loaded with second item(s). This process may repeat until the containers with the stack of containers are loaded with item(s).

In some instances, one or more bars, struts, stops, etc. may be used to engage the platform to retain the platform in bottom-most position and while the platform is loaded with the stack of containers. For example, the platform may be pushed, forced, etc. downward by the personnel, thereby overcoming the biasing force of the biasing element(s). When pushed downwards, the stops may be engaged with the platform to prevent the biasing element(s) moving the platform in a direction towards the top-most position. Once the stack of containers is loaded, however, the stops may be disengaged with the platform such that the biasing element(s) may bias the platform in a direction towards the top-most position to permit the containers to be expanded.

In some instances, the containers may include one or more holes that are disposed on, over, onto, etc. one or more posts of the base, the platform, etc. for seating, stacking, etc. the containers. For example, the containers may include a first hole and a second hole that are disposed onto a first post and a second post, respectively. In some instances, the bottom of the container may include the one or more holes that are disposed on the first post and the second post, while the top may be free to be separated from the bottom while air is blown into the cavity. As such, an engagement between the holes and the posts may secure the container to the platform before being loaded and/or while being loaded with the item(s). However, as the containers are loaded, the containers may be pulled off the first post and the second post, during which a portion of the containers adjacent to the first hole and the second hole may tear, split, rip, etc. After being separated from the platform, for example, the container may be sealed and placed on a material handling equipment (e.g., chute, slide, conveyor), into a bin (e.g., tote, gaylord, etc.) to be further processed (e.g., for shipment, induction, etc.).

The device may include an arm assembly rotatably coupled to the base. The arm assembly may move between a first position in which the stack of containers are secured on the platform, and a second position in which the stack of containers are capable of being loaded onto the platform. For example, in the first position, the front of the containers may be disposed between the arm assembly and the platform. The first position may be considered a closed position of the arm assembly, while the second position may be considered an open position of the arm assembly. The arm assembly, as will be explained herein, may include a manifold that directs air from the fan(s) and into the cavity of the container. The manifold may include any number of ducts, such as three, four, etc., that route air into the cavity of the container. The ducts may include louvers, fins, etc. to uniformly disperse air from the fan(s) into the cavity to reduce vortex and/or an uneven, uniform, etc. expansion of the container.

The fan(s) may be disposed on the base or the arm assembly. The fan(s) may represent any suitable fan, such as a radial fan, a centrifugal fan, an axial fan, etc. In some instances, the device may include blower(s) (e.g., radial blower, centrifugal blower, axial blower, etc.) instead of the fan(s). Still, in an embodiment, rather than including fan(s) and/or the blower(s), compressed air from a compressor, reservoir, etc. may be routed into the container. In such instances, the device may include values, conduits, etc. to route the air into the container, for example. The fan(s) are fluidly connected to the manifold such that as air is blown into the manifold, the manifold may direct the air through the ducts and into the container. For example, the air may be blown into the front of the container. As the air is blown into the cavity, the air may urge, force, etc. sides of the container to separate, thereby expanding the container. For example, as air is blown into the container sides, ends, the top, the bottom, etc. of the container may separate to permit the item(s) to be loaded into the container.

The fan(s) may be powered on/off via a switch of the device. For example, when not in use, the switch may be actuated to power off the fan(s). Conversely, when in use, the switch may be actuated to power on the fan(s). In some instances, the fan(s) may operate according to certain setting(s), such as fan profiles, that are associated with a certain fan speed, cubic feet per minute (CFM), etc. Adjusting the setting(s) may adjust an amount of air blown into the cavity. For example, depending on the size of the container, a material of the container, the item(s) being loaded into the container, etc., the fan profile may be adjusted accordingly. To illustrate, if the item(s) to be loaded into the container are small in nature (e.g., small footprint, dimension, etc.), the fan(s) may be reduced in speed to blow less air into the cavity than if the item(s) to be loaded are larger in nature. Forcing more air into the container may cause the container to expand by a greater amount to permit the larger item(s) to be conveniently loaded into the container.

Moreover, if multiple item(s) are to be loaded into the container, less air may be blown into the cavity to keep the container enlarged. For example, once a first item is loaded into the container, the first item may at least partially keep the container enlarged. After the first item is loaded into the container, the speed of the fan may be reduced. Reducing the speed of the fan may take advantage of the first item already residing in the container keeping the container at least partially expanded while additional item(s) are loaded into the container.

In some instances, sensor(s) may be used to control the device and/or the fan(s), for example. The sensor(s) may represent any suitable sensor(s), such as cameras, proximity sensor(s), airflow sensor(s), air pressure sensor(s), contact sensor(s), LiDAR sensor(s), infrared (IR) sensor(s), acoustic sensor(s), weight sensor(s), etc. For example, the sensor(s) may measure airflow into and/or out of the container, a distribution of airflow throughout the container, etc. In addition, the sensor(s) may be used to monitor the device, personnel loading the item(s), robotic elements (e.g., end effectors) loading the item(s), and so forth.

The setting(s) of the fan(s), for example, may be controlled based at least in part on sensor data generated by the sensor(s). For example, the sensor(s) may be used to detect (e.g., scan, read, image, etc.) the item(s) being loaded into the container for use in controlling the speed of the fan (e.g., via a potentiometer). As another example, the sensor(s) may be used to detect whether the personnel or robotic elements are loading the container. If not, the fan(s) may be powered off, reduced in speed, etc. Moreover, the airflows or flowrate may be compared to thresholds, for example, to determine whether to adjust the speed, fan profile, etc. Still, the sensor(s) may be used to determine whether the arm is in the first position or the second position. When in the first position, for example, the fan(s) may be permitted to be powered on, while when in the second position, the fan(s) may be refrained from being powered on. In some instances, the fan profile(s) may be based at least in part on whether the item(s) have already been loaded into the container, an amount of the item(s) that have already been loaded into the container, characteristic(s) of the item(s) (e.g., size, shape, weight, etc.), and so forth.

In some instances, the sensor(s) may be a component of the device or separate from the device. In instances in which the sensor(s) are separate from the device, the sensor(s) may communicatively couple to the device(s). The sensor(s) may be disposed overhead of the device, a station at which the personnel/robotic element(s) operate, within a mat (e.g., rug, floor covering) disposed at the station, and so forth. The sensor(s) may also be disposed within electronic device(s), such as tablets, wearables, mobile devices, etc. used by the personnel.

In some instances, the device may include computing components to process the sensor data from the sensor(s) to determine the setting(s). Additionally, the device may communicatively couple to one or more other electronic device(s), remote computing resource(s), etc. that process the sensor data to determine the setting(s). In such instances, the device may communicatively couple to the electronic device, remote computing resource(s), etc. via one or more wired or wireless network(s) (e.g., Wi-Fi, Bluetooth, etc.). The device, in such instances, may include suitable network interface(s) for communicating over the network(s).

Any number of the device(s) may be located at the station for loading the containers. For example, a station may include a first device used to expand first containers loaded into the first device and a second device used to expand second containers loaded into the second device. In some instances, the first device and the second device may have separate fan(s) to expand the first containers and the second containers, respectively, but may share computing components for determining whether, for example, the arm assemblies of the devices are in the closed position for permitting the fan(s) to actuate, whether the fan(s) are powered on/off, and so forth.

The present disclosure provides an overall understanding of the principles of the structure, function, device, and system disclosed herein. One or more examples of the present disclosure are illustrated in the accompanying drawings. Those of ordinary skill in the art will understand and appreciate that the devices, the systems, and/or the methods specifically described herein and illustrated in the accompanying drawings are non-limiting embodiments. The features illustrated or described in connection with one embodiment or instance may be combined with the features of other embodiments or instances. Such modifications and variations are intended to be included within the scope of the disclosure and appended claims.

FIG. 1 illustrates an example device 100 that assists in opening a container 102 to permit the container 102 to be loaded with item(s), according to examples of the present disclosure. In some instances, the device 100 may include a base 104 and an arm assembly 106 coupled to the base 104. The base 104 may support the device 100, such as on a counter, desk, table, etc. The arm assembly 106 transitions between a closed state and an open state. In the open state, the container 102 may be loaded into the device 100, whereas in the closed state, the container 102 may be temporarily secured on the device 100. In FIG. 1, the arm assembly 106 is shown in the closed state.

The device 100 includes fan(s) 108 that assist in opening the container 102. For example, the container 102 may be initially closed, such as being collapsed. The fan(s) 108 may force air into the container 102 to open, erect, inflate, enlarge, expand, etc. the container 102, as shown in FIG. 1. The fan(s) 108 may blow air into the container 102 before, during, and/or after the item(s) are loaded.

The container 102 may include a front 110, a back 112 opposite the front 110, a top 114, a bottom 116 opposite the top 114, a first side 118, and a second side 120 opposite the first side 118. The front 110 may include an opening 154 to receive the air from the fan(s) 108. A cavity 122 of the container 102, which is ultimately loaded with the item(s), may be defined between the front 110, the back 112, the top 114, the bottom 116, the first side 118, and the second side 120. Before the container 102 is expanded, the top 114 and the bottom 116 may be in close proximity to one another, and the first side 118 and the second side may be collapsed. However, upon actuation of the fan(s) 108, air may be blown into the cavity 122, via the opening 154, for causing the container 102 to expand and permit the item(s) to be conveniently loaded into the cavity 122.

The container 102 may represent any suitable container, such as bags, envelopes, bubble mailers, etc. The container 102 may be manufactured from paper-based products or plastic-based products. In some instances, a portion of the bottom 116, proximate to the front 110 may be secured on a wicket, beneath a shelf 124 of the arm assembly 106, to secure the container 102 to the device 100 and prevent the container 102 from dislodging, freeing, etc. from the device 100 upon actuation of the fan(s) 108. The portion of the bottom 116 disposed beneath the shelf 124 (e.g., in the Y-direction) is shown in dashed lines in FIG. 1. Although the device 100 is shown including a single container 102, the device 100 may be loaded with a stack, magazine, etc. of the containers 102. Accordingly, as one of the containers 102 is loaded with the item(s) and removed from the device 100, another of the containers 102 may be loaded with subsequent item(s).

The device 100 may include a platform 126 that receives or is loaded with empty containers 102. For example, a stack of empty containers 102 may be placed on the platform 126. The device 100 may include one or more biasing element(s) 128 that urge the platform 126 and the containers 102 upwards (e.g., in the Y-direction), such that the container 102 is positioned adjacent to an outlet for the fan(s) 108. The biasing element(s) 128 may be positioned proximate to a back 130 of the device 100, opposite a front 132 of the device 100 where the arm assembly 106 rotatably couples to the base 104. The platform 126 may be disposed along a rail 134 at the back 130 of the device 100. As the biasing element(s) 128 act on the platform 126, the platform 126 may move along the rail 134.

The platform 126 may have a bottom-most position and a top-most position. In the bottom-most position, the platform 126 may be loaded with the empty containers 102, whereas in the top-most position, the platform 126 may be emptied of the containers (e.g., all the containers 102 have been filled). The biasing element(s) 128 serve to force the platform 126 upwards to dispose a top-most container 102 adjacent to the outlet of the fan(s) 108 for being expanded. As the containers 102 are loaded and removed from the platform 126, the biasing element(s) 128 move the platform 126 in a direction towards the top-most position. As the containers 102 move towards the top-most position, the air is forced into the cavity 122 of the top-most container to expand the container 102 and permit the container 102 to be loaded with the item(s).

To illustrate, as a first container is expanded and loaded with first item(s), the first container may be removed from the platform 126. Once the first container is removed, the biasing element(s) 128 act on the platform 126 to urge the stack of containers upwards, for example, in a direction towards the outlet of the fan(s) 108, such that a second container may be expanded and loaded with second item(s).

This process may repeat until the containers 102 with the stack of containers are loaded with item(s).

The fan(s) 108 may be disposed on the base 104 or the arm assembly 106. The fan(s) 108 may represent any suitable fan, such as a radial fan, a centrifugal fan, an axial fan, etc. In some instances, the device 100 may include blower(s) instead of the fan(s) 108. Additionally, rather than including the fan(s) 108 and/or the blower(s), compressed air from a compressor, reservoir, etc. may be routed into the containers 102. In such instances, the device may include values, conduits, etc. to route the air into the containers 102. Details of air routing into the cavity 122 are discussed herein, however, generally the fan(s) 108 is fluidly connected to a manifold that directs the air through into the cavity 122. The manifold may include any number of ducts, such as three, four, etc., that route air into the cavity 122. The ducts may uniformly disperse air from the fan(s) 108 into the cavity 122 to reduce vortex and/or an uneven, uniform, etc. expansion of the container 102.

The device 100 is shown including processor(s) 136 and memory 138, where the processor(s) 136 may perform various functions and operations associated with controlling the device 100, and the memory 138 may store instructions executable by the processor(s) 136 to perform the operations described herein. In some instances, the fan(s) 108 may operate according to setting(s) 140, where the setting(s) 140 may indicate a speed of the fan(s) 108, an airflow associated with the fan(s) 108 (e.g., CFM), etc. In some instances, the setting(s) 140 may be associated with a fan profile of the fan(s) 108. For example, depending upon the container 102 and/or the item(s) being loaded into the container 102, a speed of the fan(s) 108 may be adjusted to control an amount of air forced into the container 102. For example, depending upon the size of the container 102, a material of the container 102, the item(s) being loaded into the container 102, etc., the setting(s) 140 may be adjusted. To illustrate, if the item(s) being loaded into the container 102 are small in nature (e.g., small footprint, dimension, etc.), the fan(s) 108 may be reduced in speed to blow less air into the cavity 122 than if the item(s) being loaded are larger in nature. Forcing more air into the container 102 may cause the container 102 to expand by a greater amount to permit the larger item(s) to be conveniently loaded into the container 102. As another example, depending upon the material of the container 102, a speed of the fan(s) 108 may be adjusted to expand the container 102.

The device 100 is further shown including sensor(s) 142, where the sensor(s) 142 may represent any suitable sensor(s), such as camera(s), proximity sensor(s), airflow sensor(s), air pressure sensor(s), contact sensor(s), LiDAR sensor(s), infrared (IR) sensor(s), acoustic sensor(s), weight sensor(s), etc. The sensor(s) may generate sensor data 144 indicative of, or associated with, an airflow into and/or out of the container 102, a distribution of airflow throughout the container 102, a speed of the fan(s) 108, etc. In addition, the sensor(s) 142 may be used to monitor the device 100, personnel loading the item(s) into the container 102, robotic elements (e.g., end effectors) loading the item(s) into the container 102, and so forth.

Although the sensor(s) 142 are shown being component(s) of the device 100, in some instances, the sensor(s) 142 may be components of other systems, devices, etc. disposed within an environment of the device 100. For example, the sensor(s) 142 may be disposed overhead of the device 100, a station at which the personnel/robotic element(s) operate, within a mat (e.g., rug, floor covering) disposed at the station, and so forth. In such instances, the sensor(s) 142 or other devices employing the sensor(s) 142 may communicatively couple to the device over one or more network(s) 146.

In some instances, the sensor data 144 may be used to at least partially control an operation of the device 100. For example, the sensor(s) 142 may generate sensor data 144 associated with item(s) being loaded into the container 102 for use in controlling the speed of the fan(s) 108 (e.g., via a potentiometer). The sensor(s) 142 may scan, read, image, etc. the item(s), and then the device 100 may determine the speed of the fan(s) 108 based on the type, size, material, shape, etc. of item(s). In some instances, the setting(s) 140 may be based at least in part on whether the item(s) have already been loaded into the container 102, an amount of the item(s) that have already been loaded into the container 102, characteristic(s) of the item(s) (e.g., size, shape, weight, etc.), and so forth. For example, once a first item is loaded into the container 102, the speed of the fan(s) 108 may be reduced, as the first item may assist in holding the container 102 open while other item(s) (e.g., a second item, third item, etc.) are loaded into the container 102.

As another example, the sensor(s) 142 may generate sensor data 144 indicative of a presence or absence of whether personnel or robotic elements are loading the container 102, or at a station associated with the device 100. If not, the fan(s) 108 may be powered off, reduced in speed, etc. to save power, reduce noise, etc. Moreover, the sensor data 144 may indicate an airflow throughout the container 102. If the airflow indicates vortexes or particular portions of the container 102 that are being uniformly inflated, the speed of the fan(s) 108 may be adjusted.

Additionally, the sensor(s) 142 may generate sensor data 144 that indicates a position of the arm assembly 106. For example, when the arm assembly 106 is in the closed position, the fan(s) 108 may be permitted to be powered on. Comparatively, when the arm assembly 106 is in the open position, the fan(s) 108 may be refrained from powering on.

As indicated above, the device 100 may process the sensor data 144 to control the fan(s) 108, for example. In some instances, the device 100 may communicatively couple to one or more electronic device(s), such as a mobile device 152 (e.g., phone, wearable, tablet, etc.), remote computing resource(s) 148, etc., that process the sensor data 144 to determine the setting(s) 140, control the device 100, etc. In such instances, the device 100 may communicatively couple to the mobile device 152, the remote computing resource(s), etc. via the network(s) 146, which may be wired or wireless (e.g., Wi-Fi, Bluetooth, Cellular, etc.). The device 100, in such instances, may include suitable network interface(s) for communicating over the network(s).

In some instances, the device 100 may include one or more input/output (I/O) component(s) 150. The I/O component(s) 150 may represent buttons, switches, lighting element(s), speaker(s), etc. In some instances, the I/O component(s) 150 may output indications (e.g., visual, audible, etc.) associated with an operational status of the device 100. The operation status may indicate whether the device 100 is on/off, whether the fan(s) 108 is on/off, a speed of the fan(s) 108, a number of the containers 102 in the stack of container (e.g., full, empty, needing to be replaced, etc.), connectivity with other device(s), and so forth.

Although the device 100 is shown expanding a single container, in some instances, multiple containers may be loaded onto the device 100. In such instances, the device 100 may be used to expand more than one container simultaneously, whereby the containers may be respectively loaded with item(s).

In some instances, the remote computing resource(s) 148 may be implemented as one or more servers and may, in some instances, form a portion of a network-accessible computing platform implemented as a computing infrastructure of processors, storage, software, data access, etc. that is maintained and accessible via a network such as the Internet. The remote computing resource(s) 148 does not require end-user knowledge of the physical location and configuration of the system that delivers the services. Common expressions associated with the remote computing resource(s) 148 may include "on-demand computing", "software as a service (SaaS)", "platform computing", "network-accessible platform", "cloud services", "data centers", etc. However, in some instances, the remote computing resource(s) 148 may be located within a same environment or different environment as the device 100.

As used herein, a processor, such as the processor(s) 136 may include multiple processors and/or a processor having multiple cores. Further, the processor(s) 136 may comprise one or more cores of different types. For example, the processor(s) 136 may include application processor units, graphic processing units, and so forth. In one implementation, the processor(s) 136 may comprise a microcontroller and/or a microprocessor. The processor(s) 136 may include a graphics processing unit (GPU), a microprocessor, a digital signal processor or other processing units or components known in the art. Alternatively, or in addition, the functionally described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) 136 may possess its own local memory, which also may store program components, program data, and/or one or more operating systems.

Memory, such as the memory 138 may include volatile and nonvolatile memory, removable and non-removable media implemented in any method or technology for storage of information, such as computer-readable instructions, data structures, program component, or other data. Such memory may include, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory may be implemented as computer-readable storage media ("CRSM"), which may be any available physical media accessible by the processor(s) to execute instructions stored on the memory. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processor(s) 136. The memory 138 is an example of non-transitory computer-readable media. The memory 138 may store an operating system and one or more software applications, instructions, programs, and/or data to implement the methods described herein and the functions attributed to the various systems.

Figure 2:
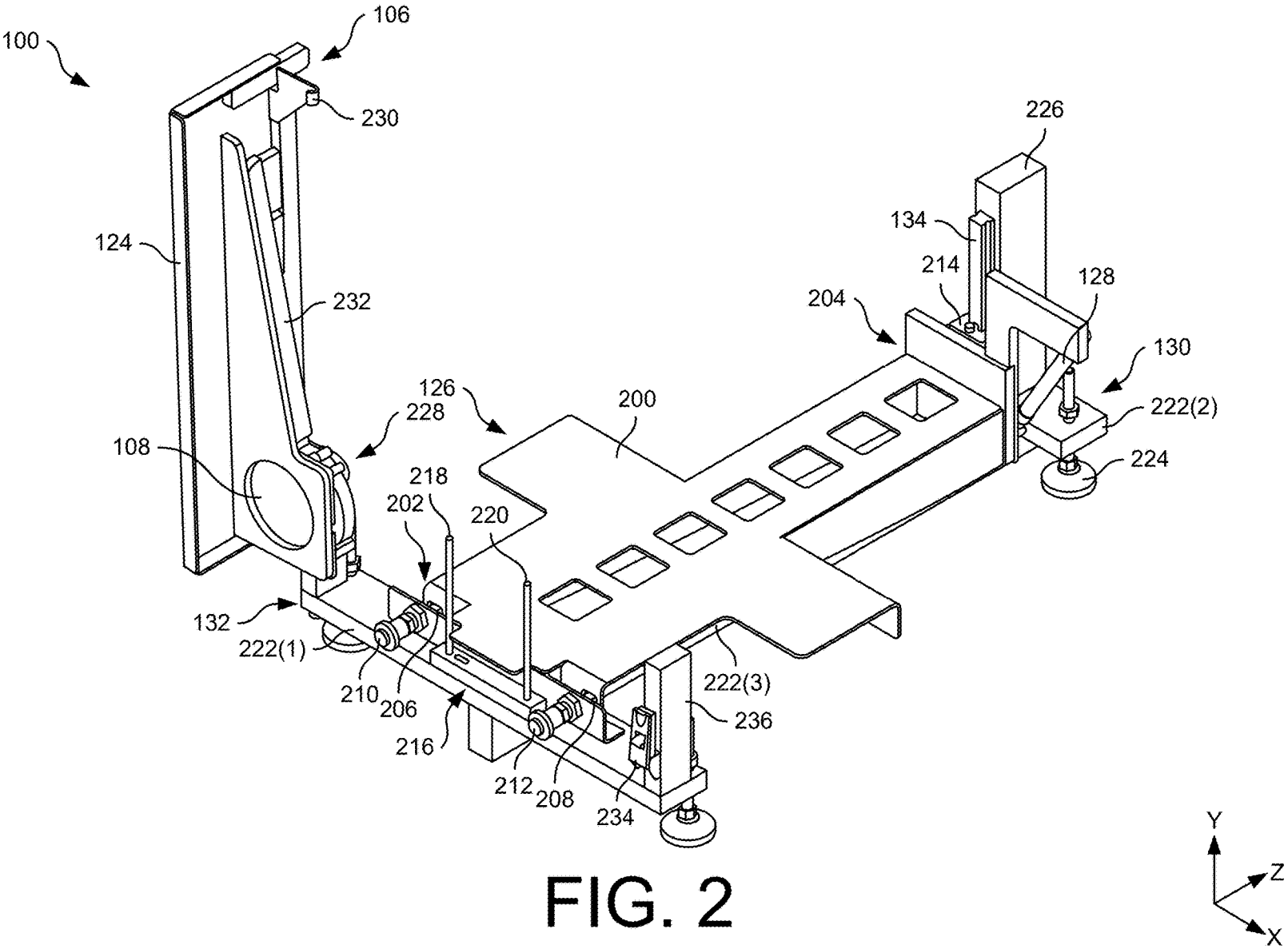
FIG. 2 illustrates the device of FIG. 1, showing an example arm assembly of the device in an open position, according to examples of the present disclosure.

FIG. 2 illustrates the device 100, showing the arm assembly 106 in the open position, according to examples of the present disclosure. For example, from the closed position, as shown in FIG. 1, the arm assembly 106 may rotate counterclockwise (e.g., about the Z-axis). In some instances, the arm assembly 106 may rotate ninety degrees from the closed position to the open position.

As shown in FIG. 2, the device 100 may be emptied of the containers 102. The containers 102 may be loaded onto the platform 126, for example, so as to rest on a top surface 200 of the platform 126. The platform 126 may include a first end 202 and a second end 204 spaced apart from the first end 202. A length of the platform 126 may extend between the first end 202 and the second end 204. The length, as well as a width of the platform 126 (e.g., in the X-direction), may provide support to the containers 102.

The first end 202 may include a first channel 206 and a second channel 208 engaged by a first stop 210 and a second stop 212, respectively. The first stop 210 and the second stop 212 may represent pins, posts, protrusions, etc. that are to be disposed in the first channel 206 and the second channel 208, respectively. For example, to keep the platform 126 in the bottom-most position, such as shown in FIG. 2, and while the containers 102 are being loaded onto the platform 126, the first stop 210 may be disposed or otherwise engaged within the first channel 206 and the second stop 212 may be disposed or otherwise engaged within the second channel 208. The first stop 210 and the second stop 212 may be disposed on the base 104 of the device 100.

In some instances, the first stop 210 and the second stop 212 may be pushed in a first direction (e.g., Z-direction) to engage the first channel 206 and the second channel 208, respectively. When the first stop 210 engages with the first channel 206 and the second stop 212 engages with the second channel 208, the platform 126 may be prevented from moving in a direction towards the top-most position. For example, the first stop 210 and the second stop 212 may restrain the biasing element(s) 128 acting on the platform 126 and moving the platform 126 in the direction towards the top-most position (e.g., in the Y-direction).

When the containers 102 are loaded onto the platform 126, the first stop 210 and the second stop 212 may be disengaged from the first channel 206 and the second channel 208, respectively. In some instances, the arm assembly 106 may first be rotated into the closed position, and then the first stop 210 and the second stop 212 may be disengaged from the first channel 206 and the second channel 208, respectively. For example, the first stop 210 and the second stop 212 may be pulled in a second direction, opposite the first direction (e.g., in the Z-direction). Therein, the biasing element(s) 128 may move the platform 126 in the direction towards the top-most position. Although the device 100 includes the first stop 210 and the second stop 212, the device 100 may include more than or less than the first stop 210 and the second stop 212. Moreover, the platform 126 may include a corresponding number of channels, and/or the stops and the channels may be located on the base 104 and the platform 126 than shown.

The second end 204 of the platform 126 may include a carriage 214 that engages with the rail 134. The carriage 214 may include channels, grooves, etc. that engage with corresponding channels, grooves, etc. of the rail 134. As the biasing element(s) 128 act on the platform 126, the carriage 214 may translate, move, etc. along the rail 134. The carriage 214 may be coupled to the platform 126 at the second end 204.

The device 100 may include a wicket 216 having a first post 218 and a second post 220. The first post 218 and the second post 220 may receive one or more holes of the container 102. For example, the containers 102 may include a first hole and a second hole that are disposed onto the first post 218 and the second post 220, respectively. In some instances, the bottom 116 of the container 102 may include the one or more holes that are disposed on the first post 218 and the second post 220, while the top 114 may be free to be separated from the bottom 116 such that as air is blown into the cavity 122, the container 102 is free to expand. An engagement between the first hole and the second hole of the container with the first post 218 and the second post 220 may secure the container 102 to the platform 126. A stack of containers may be disposed onto the first post 218 and the second post 220 to load the platform 126.

In some instances, the base 104 may include a first structural member 222(1), a second structural member 222(2), and a third structural member 222(3). The structural members 222(1)-(3) may represent bars, struts, elongated tubes, etc., which may form a frame of the base 104. The structural members 222(1)-(3) may be coupled together in any suitable manner, such as fasteners, brackets, welding, etc. The first structural member 222(1) may be disposed at the front 132 of the device 100, the second structural member 222(2) may be disposed at the back 130 of the device 100, and the third structural member 222(3) may extend between the first structural member 222(1) and the second structural member 222(2). One or more feet 224 may be disposed on the structural members 222(1)-(3) for leveling, orienting, and/or seating the device 100. The rail 134 may be coupled to the second structural member 222(2) via a post 226.

The arm assembly 106 may pivotably couple to the base 104, for example, along the first structural member 222(1), via a hinge 228. Details of the arm assembly 106 are discussed herein, however, the arm assembly 106 may include the fan(s) 108, the shelf 124, a latch 230, and a manifold 232 for routing air from the fan(s) 108 into the cavity 122. The fan(s) 108 may be powered on/off via a switch 234 of the device 100. For example, when not in use, the switch 234 may be actuated to power off the fan(s) 108. The switch 234 may be located on a post 236 that extends from the first structural member 222(1). The post 236 may also include a receptacle for engaging with the latch 230. An engagement between the latch 230 and the receptacle may secure, lock, etc. arm assembly 106 in the closed state. However, the latch 230 may be disengaged from the receptacle to permit the arm assembly 106 to transition to the open state.

Figure 3:
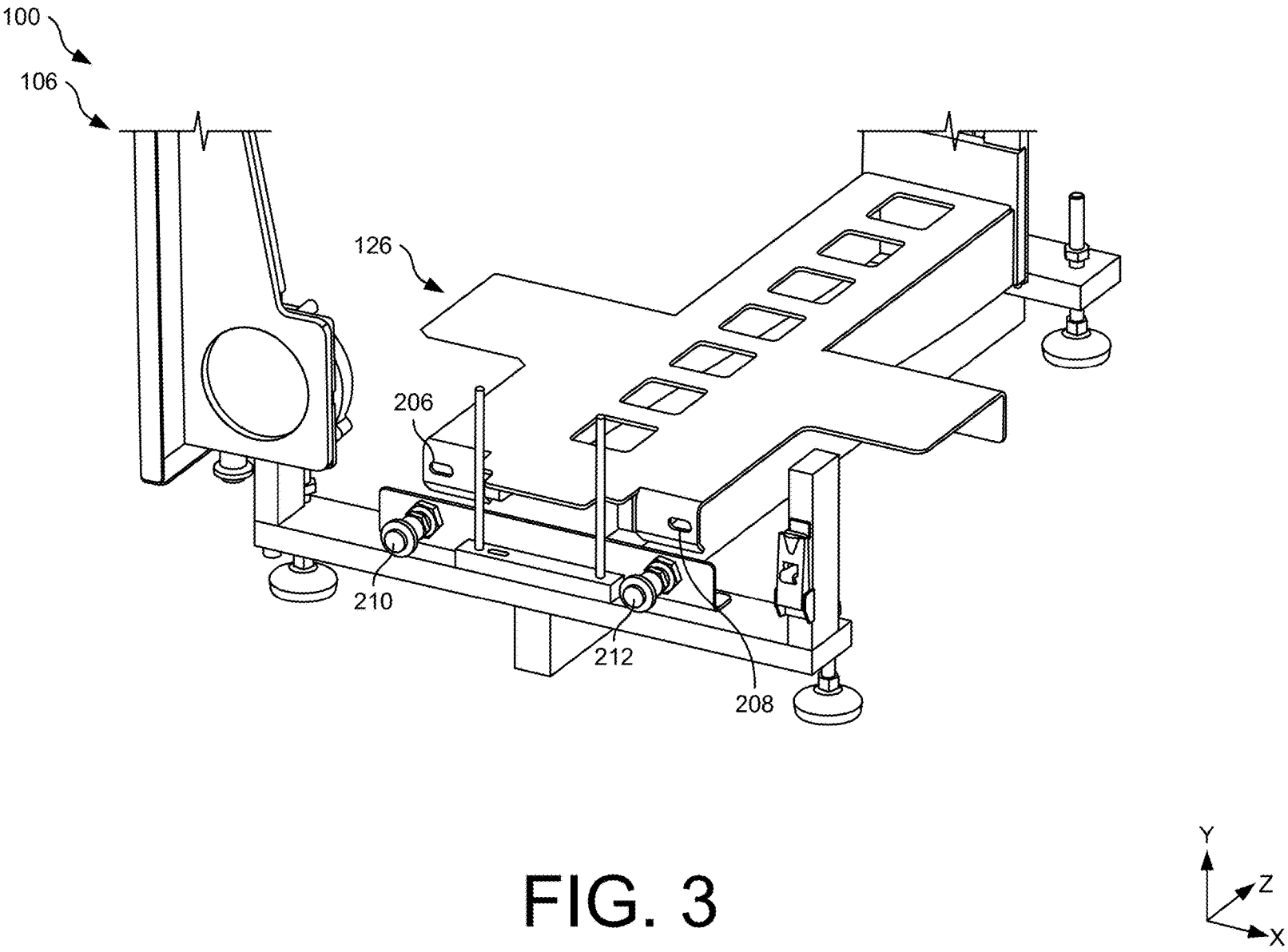
FIG. 3 illustrates a partial view of the device of FIG. 1, showing an example arm of the device assembly in an open position, according to examples of the present disclosure.

FIG. 3 illustrates a partial view of the device 100, showing the platform 126 disengaged with the first stop 210 and the second stop 212, respectively, according to examples of the present disclosure. As introduced above, first stop 210 and the second stop 212 may engage with the first channel 206 and the second channel 208, respectively, in the bottom-most position of the platform 126, to retain the platform 126 in bottom-most position. For example, while the platform 126 is being loaded with the containers 102, the first stop 210 and the second stop 212 may be disposed within the first channel 206 and the second channel 208, respectively.

To engage the first stop 210 and the second stop 212, the platform 126 may be pushed, forced, etc. downward by the personnel, thereby overcoming the biasing force of the biasing element(s) 128. When pushed downwards, the first stop 210 and the second stop 212 may be engaged with the platform 126 to prevent the biasing element(s) 128 moving the platform 126 in a direction towards the top-most position. Once the stack of containers is loaded, and the arm assembly 106 moves to the closed position, for example, the first stop 210 and the second stop 212 may be disengaged with the platform 126 such that the biasing element(s) 128 may bias the platform 126 in a direction towards the top-most position.

Figure 4:
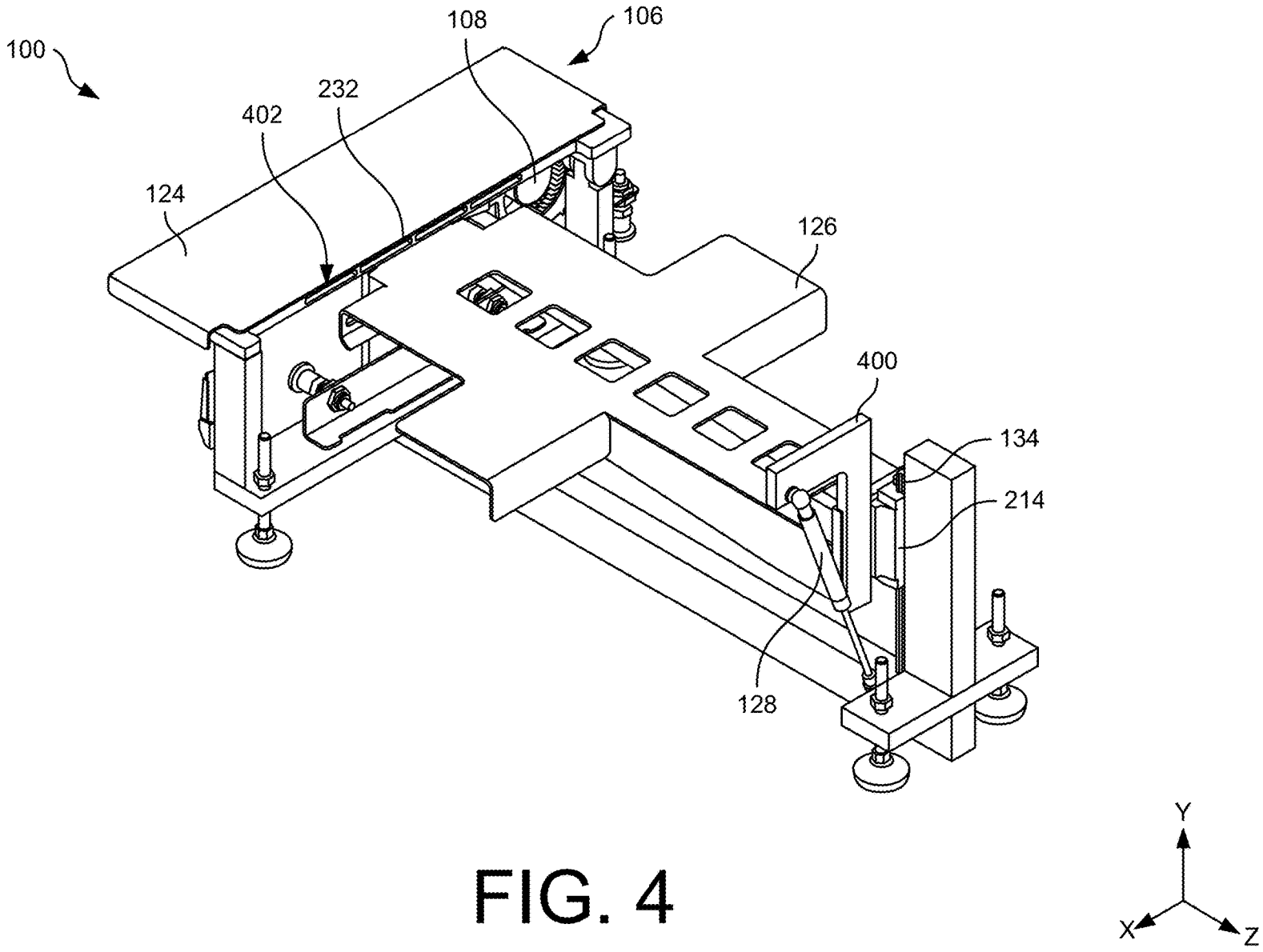
FIG. 4 illustrates the device of FIG. 1, showing an example arm assembly of the device in a closed position, according to examples of the present disclosure.

FIG. 4 illustrates the device 100, showing the arm assembly 106 in the closed position and the platform 126 in the top-most position, according to examples of the present disclosure. In FIG. 4, the containers 102 are shown being removed (or absent).

The biasing element(s) 128 act on the platform 126 to move the platform 126 to the top-most position. As the biasing element(s) 128 act on the platform 126, the carriage 214 translates along the rail 134. In some instances, the biasing element(s) 128 couple to the platform 126 via an arm 400 such that the biasing force of the biasing element(s) 128 is transferred to the platform 126.

Air from the fan(s) 108 is blown into the container 102 via the manifold 232 having one or more ducts 402. For example, the air may route from the fan(s) 108, through the manifold 232, out the ducts 402 and into the container 102. The manifold 232 is shown as including four of the ducts 402. The ducts 402 are shown being positioned vertically below the shelf 124 (e.g., in the Y-direction). The ducts 402 may be positioned such that the air is forced into a top-most container of the containers 102.

Figure 5:
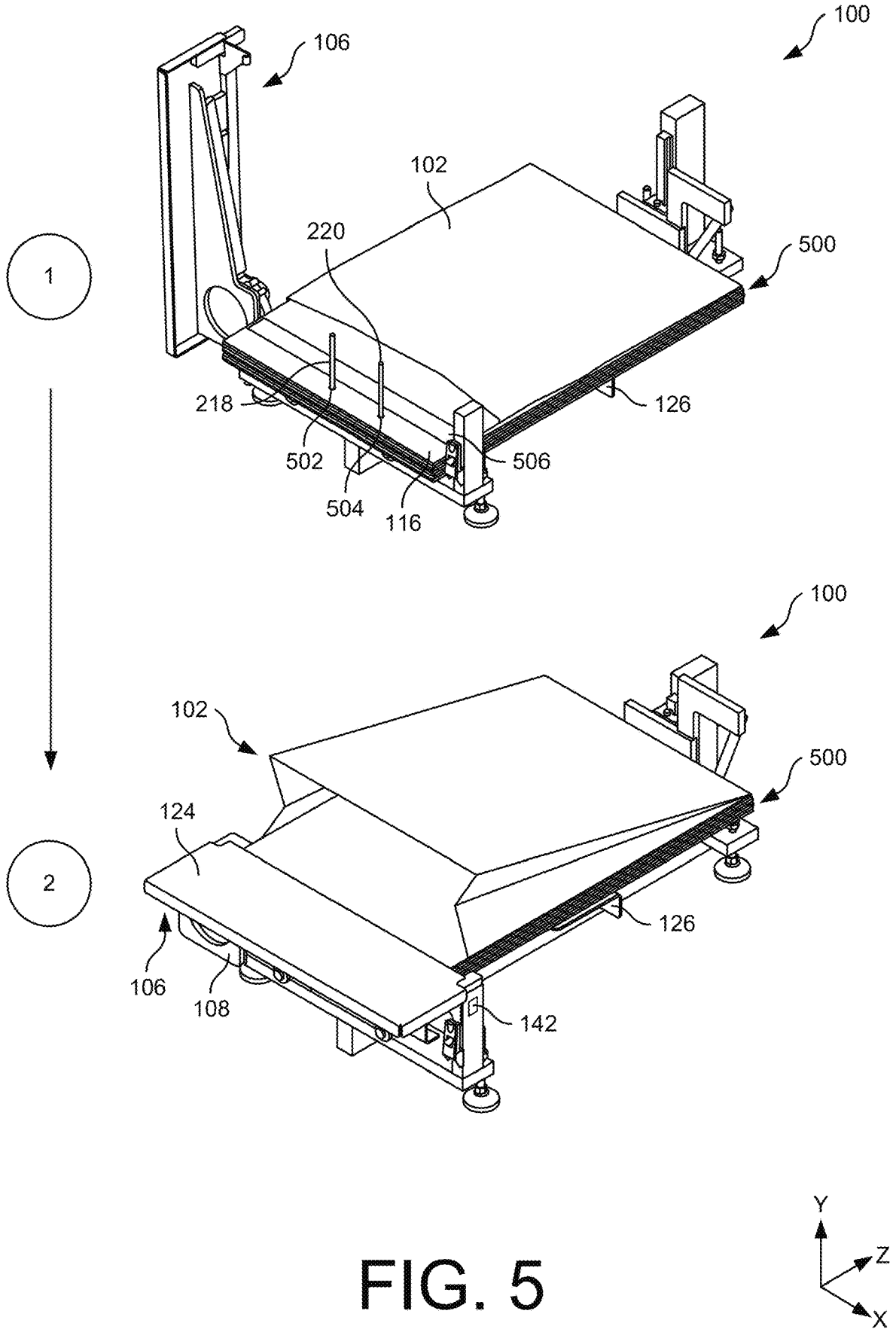
FIG. 5 illustrates an example sequence to load containers onto the device of FIG. 1, according to examples of the present disclosure.

FIG. 5 illustrates an example sequence for loading the containers 102 onto the device 100, according to examples of the present disclosure. As shown at "1" in FIG. 5, the arm assembly 106 may be moved to the open position. Therein, a stack of containers 500 may be loaded onto the platform 126. Before loading the stack of containers 500, the platform 126 may be moved to the bottom-most position, whereby the first stop 210 and the second stop 212 may engaged with the first channel 206 and the second channel 208, respectively, to keep the platform 126 in the bottom-most position.

In some instances, the containers 102 may include one or more holes that are disposed on, over, onto, etc. the first post 218 and the second post 220 of the wicket 216. For example, the containers 102 may include a first hole 502 and a second hole 504 disposed onto the first post 218 and the second post 220. The disposition of the first hole 502 and the second hole 504 onto the first post 218 and the second post 220 may seat, stack, align, etc. the containers 102 on the platform 126. Moreover, an engagement between the first hole 502 and the second hole 504 and the first post 218 and the second post 220 may secure the containers 102 to the platform 126.

The first hole 502 and the second hole 504 may be disposed through the bottom 116 of the container 102. The first hole 502 and the second hole 504 may be positioned on the bottom 116, such that as air is blown into the cavity 122, the top 114 is free to separate from the bottom 116. As the containers 102 are loaded and filled with the item(s), the containers 102 may be pulled off the first post 218 and the second post 220. When the container 102 is pulled off the first post 218 and the second post 220, a portion of the container 102 adjacent to the first hole 502 and the second hole 504 may tear, split, rip, etc., thereby allowing the container 102 to separate from the device 100. After being separated from the device 100, for example, the container 102 may be sealed and further processed. The container 102 may include a removable adhesive strip 506 for sealing the container 102 once the container 102 is loaded with the item(s).

Once the stack of containers 500 is loaded, the arm assembly 106 may transition to the closed position. For example, at "2" in FIG. 5, the arm assembly 106 may be moved to the closed position. In the closed position, the latch 230 may be engaged with a receptacle, hook, etc. on the base 104 to lock the arm assembly 106 in the closed position. The device 100 may also include sensor(s) 142 that sense the position of the arm assembly 106, for example, in the closed position. When the arm assembly 106 is positioned in the closed position, the fan(s) 108 may be permitted to operate. Example sensor(s) 142 may include a contact switch, proximity sensor, etc. The fan(s) 108 may blow air into the container before, during, and/or after the item(s) are loaded. The first hole 502 and the second hole 504 may be positioned vertically beneath the shelf 124 in the closed position.

Figure 6A:
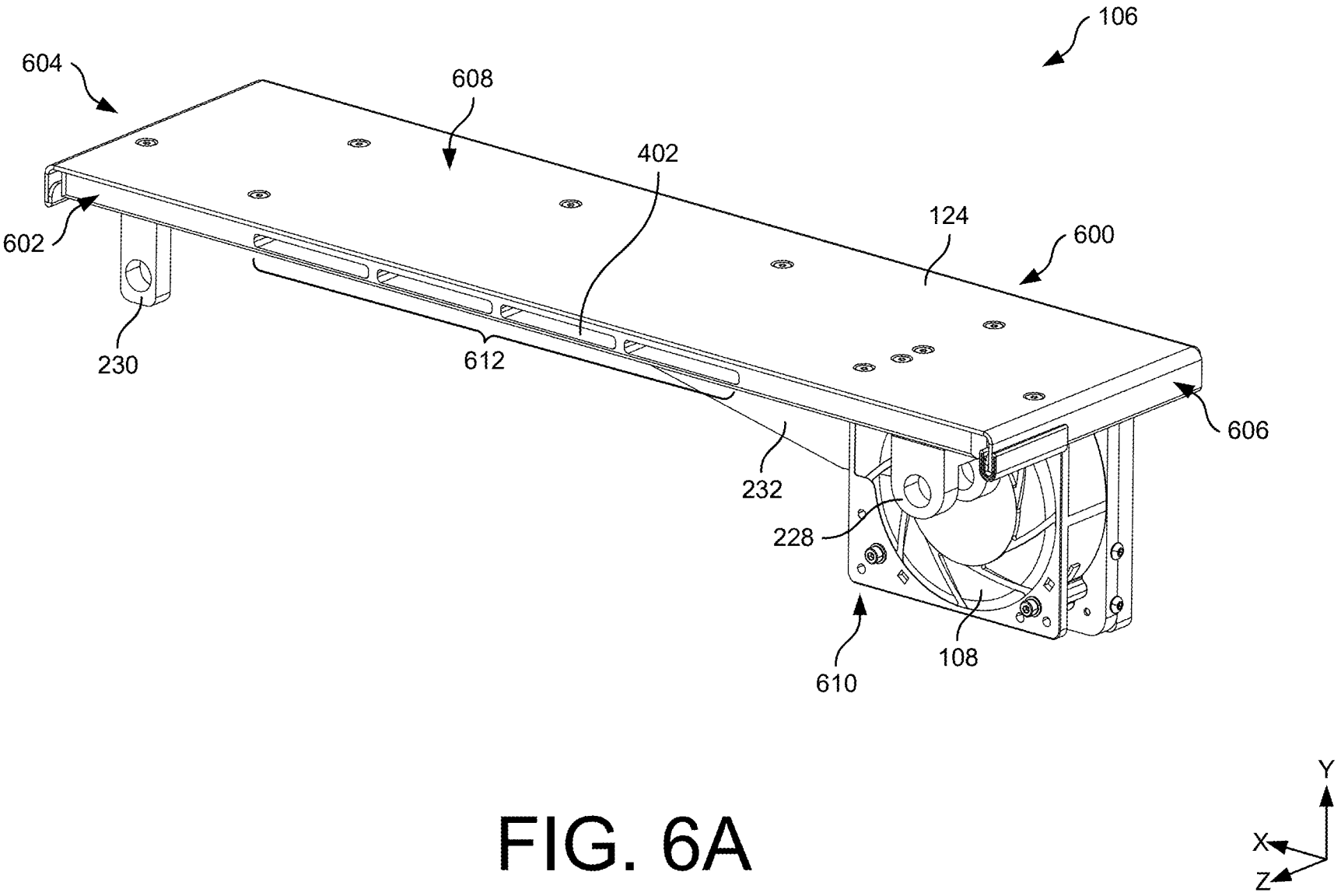
FIGS. 6A-6C illustrate an example arm assembly of the device of FIG. 1, according to examples of the present disclosure.
Figure 6B:
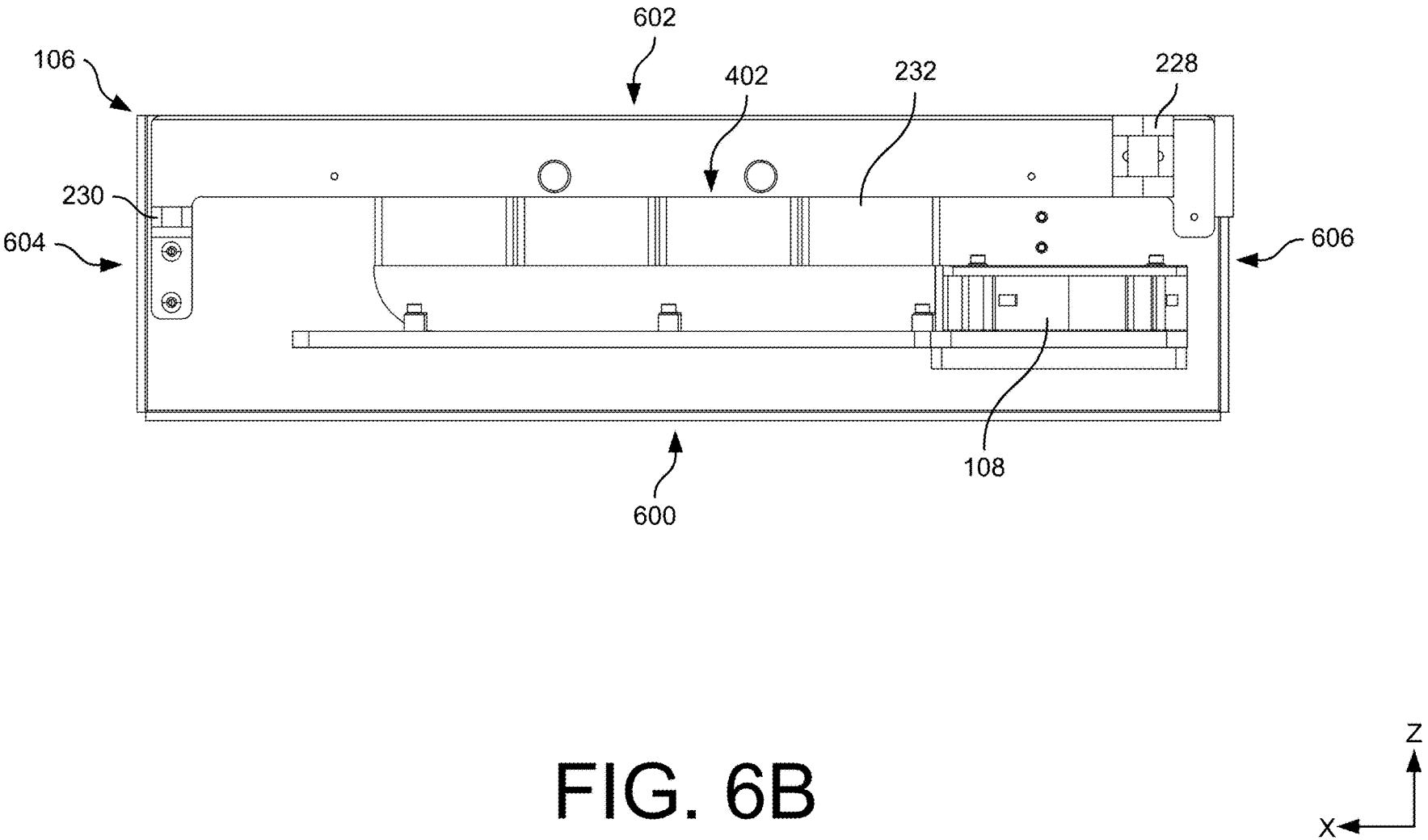
Figure 6C:
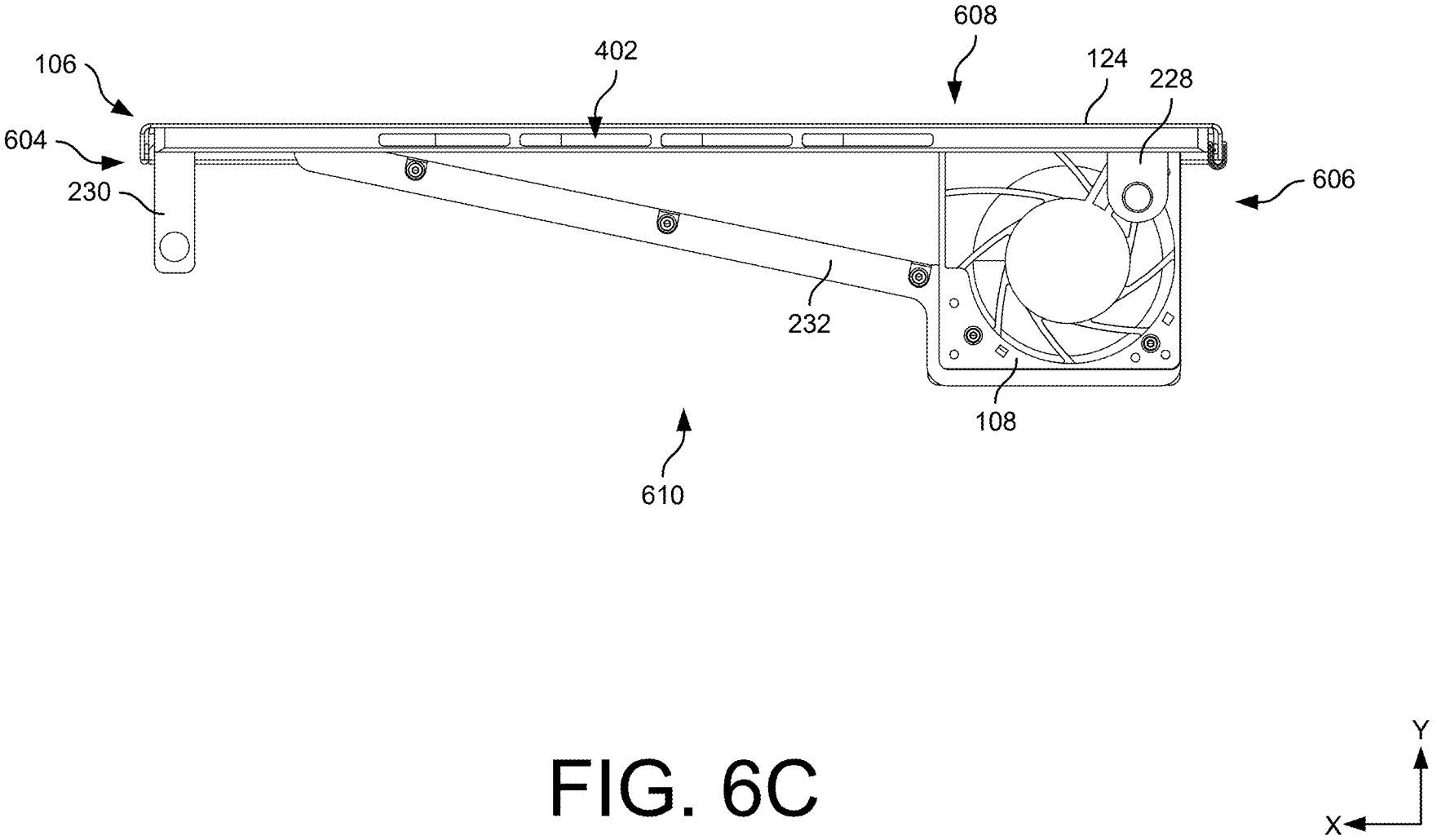

FIGS. 6A-6C illustrate details of the arm assembly 106, according to examples of the present disclosure. FIG. 6A illustrates a rear isometric view of the arm assembly 106, FIG. 6B illustrates a bottom-planar view of the arm assembly 106, and FIG. 6C illustrates a rear-planar view of the arm assembly 106.

The arm assembly 106, as introduced above, may include the fan(s) 108, the shelf 124, and the manifold 232. The arm assembly 106 may include a front 600, a back 602 opposite the front 600, a first end 604, a second end 606 opposite the first end 604, a top 608, and a bottom 610 opposite the top 608. The fan(s) 108 may be positioned on the second end 606, while the latch 230 may be positioned on the first end 604. The hinge 228 may be disposed on the second end 606. The shelf 124 may be positioned along the top 608.

The fan(s) 108 may intake air from the front 600, back 602, etc., and exhaust air out the back 602 via the ducts 402. The manifold 232 may be coupled to the shelf 124 via fasteners. The ducts 402 may be disposed across a distance 612, which may correspond to a width of the container 102. In some instances, the distance 612 may be less than, greater than, or equal to the width of the container 102.

Figure 7:
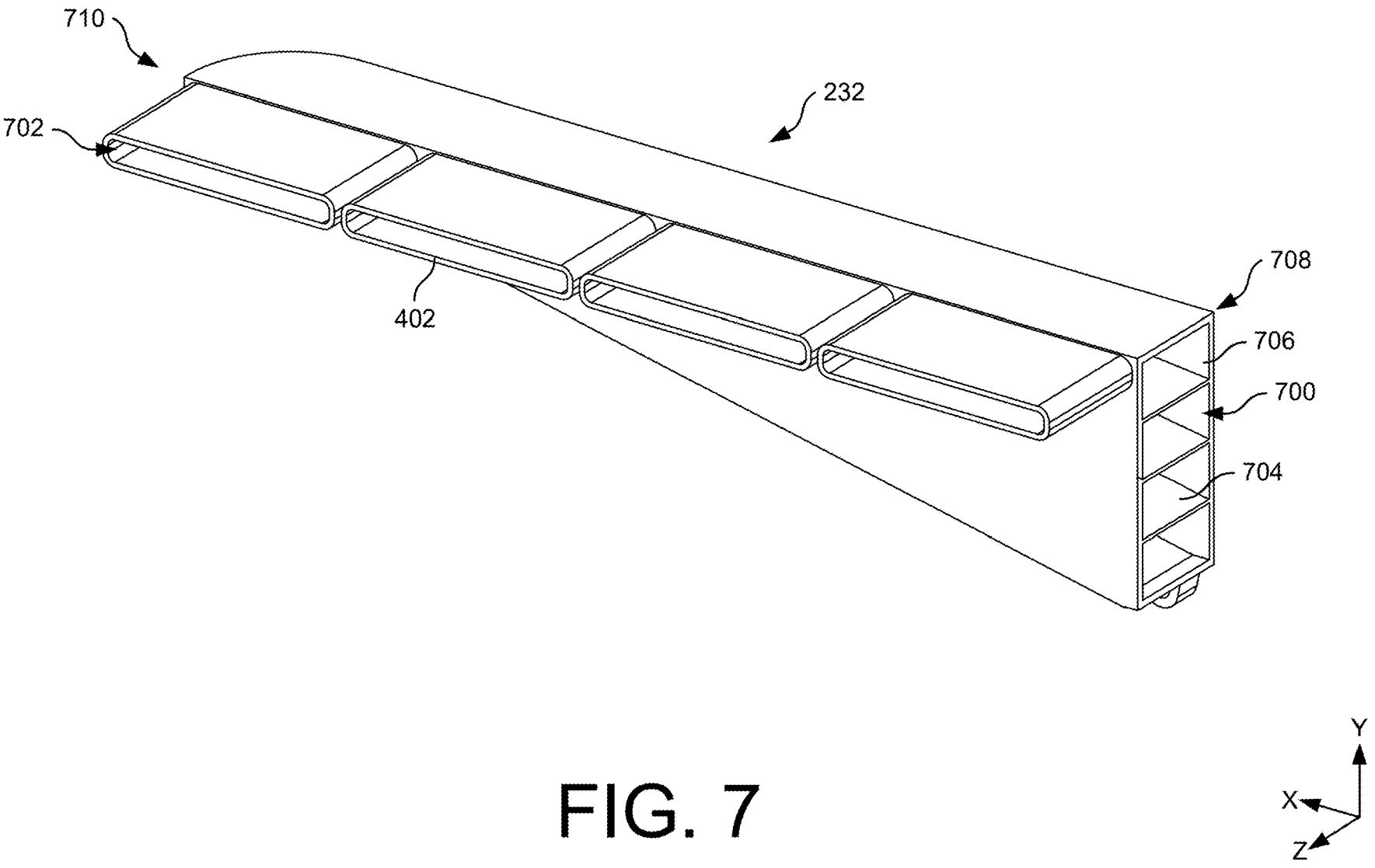
FIG. 7 illustrates an example manifold of the arm assembly of FIGS. 6A-6C, according to examples of the present disclosure.

FIG. 7 illustrates an isometric view of the manifold 232, according to examples of the present disclosure. The manifold 232 includes an inlet 700 fluidly connected to the fan(s) 108, and an outlet 702 in which the air is output into the container 102. The manifold 232 may include one or more louvers 704 disposed within an interior passageway 706 of the manifold 232. The interior passageway 706 may extend between the inlet 700 and the outlet 702.

As shown, the manifold 232 may narrow, taper, etc. in dimension between a first end 708 and a second end 710. The narrowing of the manifold 232 may provide a uniform exhaust of the air out the outlet 702. For example, the inlet 700 may be disposed at the first end 708, and in a direction towards the second end 710 (e.g., in the X-direction), a height of the manifold 232 may decrease (e.g., in the Y-direction). In some instances, the velocity of air exiting the ducts 402 may be similar. The louvers 704 may additionally assist in preventing turbulent flow within the interior passageway 706, and to uniformly exhaust air out the outlet 702 and into the container 102.

The manifold 232 may include four of the duct(s) 402 that define the outlet 702. In some instances, the duct(s) 402 may be similar or different in shape, size, etc. as compared to one another. Although four of the duct(s) 402 are shown, the manifold 232 may include more than or less than four of the duct(s) 402.

FIGS. 8A and 8B illustrate details of the biasing element(s) 128, according to examples of the present disclosure. As introduced above, the biasing element(s) 128 may urge the platform 126, which is shown removed in FIGS. 8A and 8B, to the top-most position. The biasing element(s) 128 may extend between the second structural member 222(2) and the arm 400. In some instances, a first end 808 of the biasing element(s) 128 couples to the second structural member 222(2), and a second end 810 of the biasing element(s) 128 couples to the arm 400. In some instances, the second end 810 may couple to different locations, positions, etc. along the arm 400 to adjust the biasing force of the biasing element(s) 128. The arm 400 couples to the platform 126, for example, via a plate 800. In addition, the plate 800 may couple to the carriage 214, which is engaged with the rail 134. As the biasing element(s) 128 urge against the arm 400, motion is imparted into the carriage 214 for traversing along the rail 134.

In some instances, the biasing element(s) 128 may be disposed at an angle 802 relative to a central vertical plane 804 of the device 100. In some instances, the central vertical plane 804 may extend through a center of the device 100 (e.g., Y-Z plane), or through the rail 134. The biasing element(s) 128 may include a central axis 806 that is disposed at the angle 802 relative to the central vertical plane 804. In some instances, the angle 802 may be an acute angle. In some instances, the angle 802 may be between twenty degrees and fifty degrees.

The angle 802 may provide a uniform bias to the platform 126 as the containers 102 are removed from the stack of containers 500. For example, disposing the biasing element(s) 128 at the angle 802 may provide a constant, even, or continuous force to the platform 126 as the platform 126 moves between the bottom-most position and the top-most position. The angle 802 may be altered, for example, through changing a position at which the second end 810 of the biasing element(s) 128 couples to the arm 400. Altering the angle 802 may adjust the force at which the biasing element(s) 128 act on the arm 400 to impart movement into the platform 126.

Figure 9:
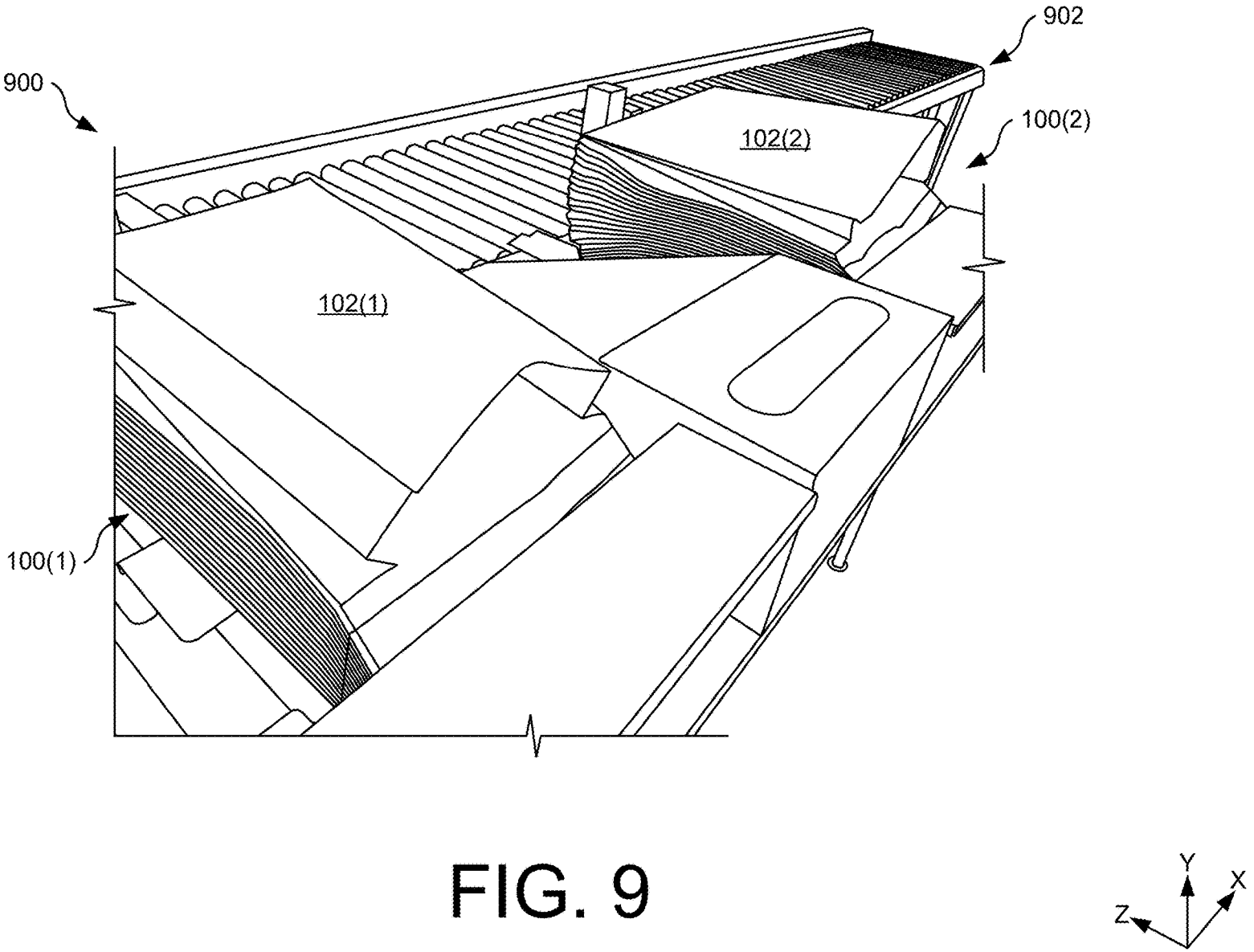
FIG. 9 illustrates an example station with one or more of the devices of FIG. 1, according to examples of the present disclosure.

FIG. 9 illustrates an example station 900 having a first device 100(1) and a second device 100(2), according to examples of the present disclosure. The first device 100(1) may include first containers 102(1) (e.g., within a first stack of containers) and the second device 100(2) may include second containers 102(2) (e.g., within a second stack of containers). The first containers 102(1) may be loaded with first item(s) while the second containers 102(2) may be loaded with second item(s). In some instances, the first containers 102(1) may be the same or different than the second containers 102(2), such as in size, shape, material, etc.

As the containers 102 are loaded with the item(s), the containers 102 may be removed from the first device 100(1) and the second device 100(2), respectively, and inducted onto a conveyor 902, for example. The conveyor 902 may route the containers 102 to other portions of an environment in which the first device 100(1) and the second device 100(2) reside. For example, the containers 102 may be further processed for shipment, sortation, distribution, etc.

Although the station 900 is shown including two of the devices 100, the station 900 may include any number of the devices 100. In some instances, the first device 100(1) and the second device 100(2) may share computing component(s) (e.g., controller). For example, the devices 100 may include separate fan(s) 108 for expanding the first containers 102(1) and the second containers 102(2), respectively, but may share computing component(s) for determining whether, for example, the arm assembly 106 of the devices 100 are in the closed position for permitting the fan(s) 108 to actuate, whether the fan(s) 108 are powered on/off, and so forth. In such instances, the first device 100(1) and the second device 100(2) may be considered a system, assembly, etc. The computing component(s) may also control a speed of the fan(s) 108 (e.g., via a potentiometer).

Figure 10A:
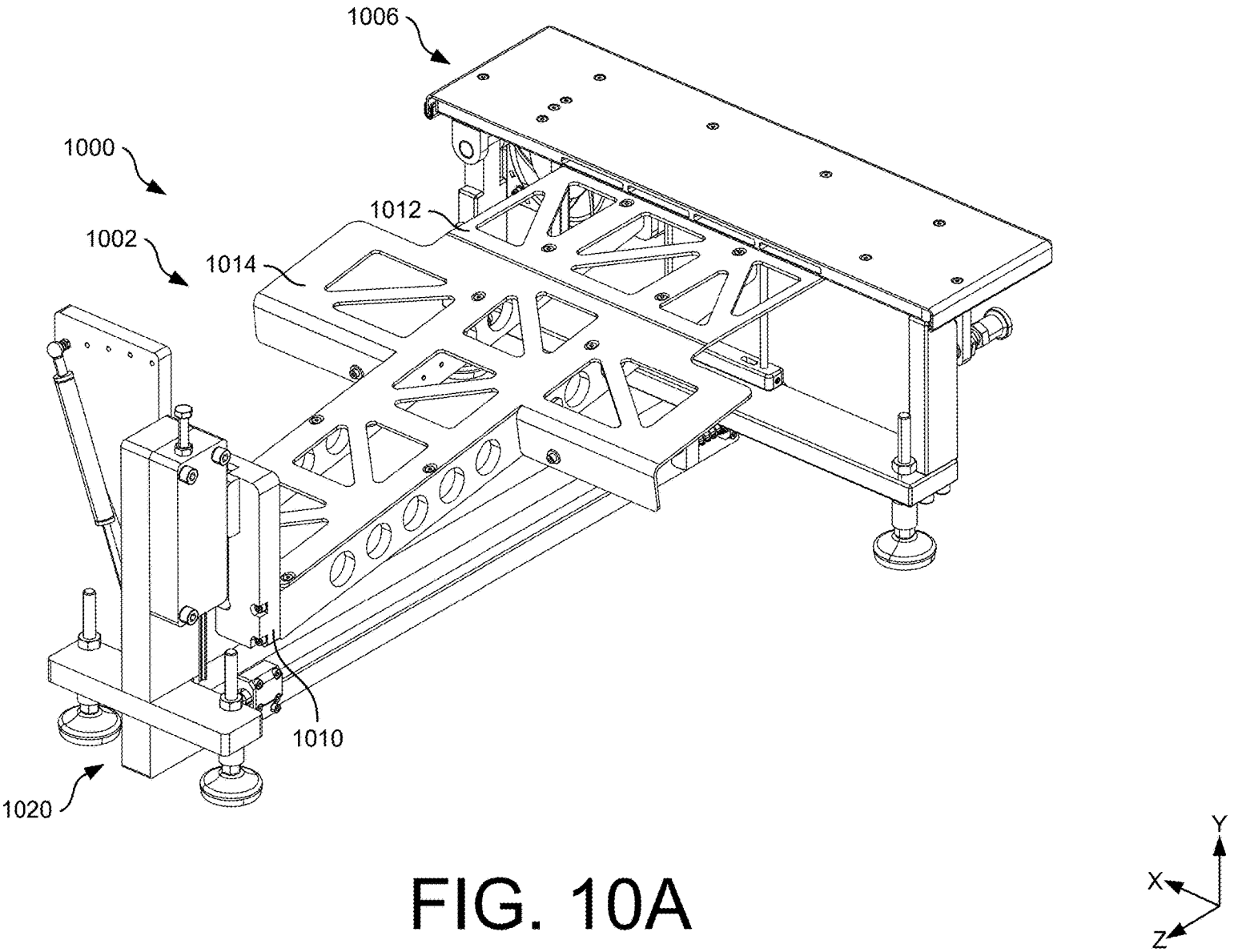
Figure 10B:
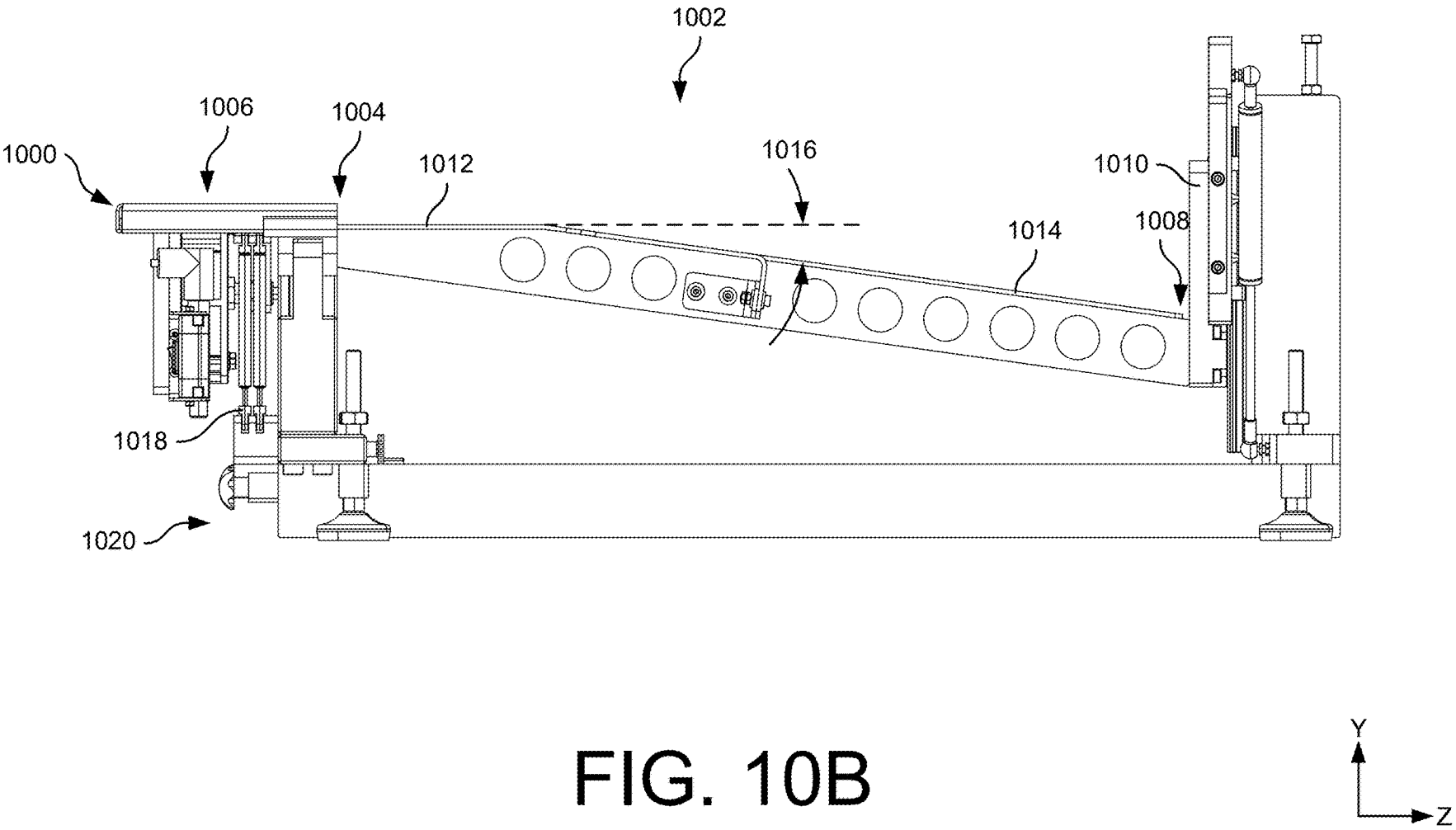

FIGS. 10A-10C illustrates an alternate device 1000, according to examples of the present disclosure. In some instances, the device 1000 may be similar to the device 100 as discussed above. However, in some instances, a platform 1002 of the device 1000 may be different than the platform 126. For example, the platform 1002 may include a first end 1004 disposed proximate to an arm assembly 1006, and a second end 1008 opposite the first end 1004, coupled to a carriage 1010. The platform 1002 may include a first portion 1012 and a second portion 1014, whereby the second portion 1014 may be non-planar with the first portion 1012. The second portion 1014 may extend between the first portion 1012 and the second end 1008. The second portion 1014 may be disposed at an angle 1016 relative to the first portion 1012. The angle 1016 may be an acute angle, may be between five and thirty degrees, etc. The angle 1016 of the second portion 1014 relative to the first portion 1012 may permit the containers 102 to be conveniently stacked on the platform 1002, for example, to compensate for a fanning of the containers 102.

The device 1000 may additionally, or alternatively, include biasing member(s) 1018 disposed between a base 1020 of the device 1000 and the arm assembly 1006. The biasing member(s) 1018 may provide a lifting force to the arm assembly 1006, for example, to lift the arm assembly 1006 between the closed position and the open position.

Figure 11:
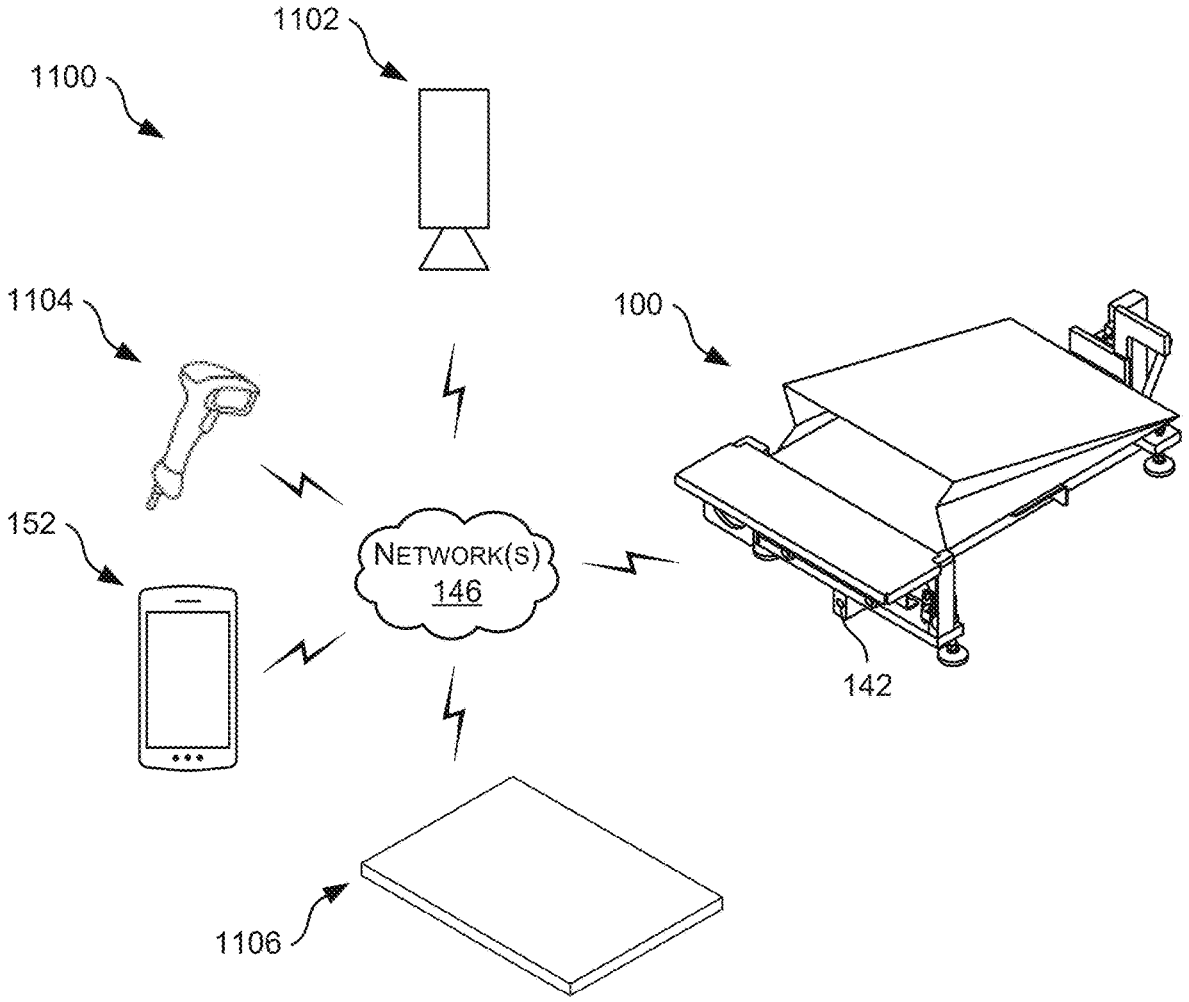
FIG. 11 illustrates an example environment associated with controlling an operation of the device of FIG. 1 or the device of FIGS. 10A-10C, according to examples of the present disclosure.

FIG. 11 illustrates an example environment 1100 including the device 100, and example device(s) that communicatively couple to the device 100 for controlling the device 100, according to examples of the present disclosure. For example, the environment 1100 may include the device 100, camera(s) 1102, the sensor(s) 142, a scanner 1104, the mobile device 152, and a mat 1106, according to examples of the present disclosure.

The camera(s) 1102 may be disposed overhead, alongside, etc. the device 100 for sensing a presence of personnel operating the device 100. For example, the camera(s) 1102 may generate image data that is analyzed to detect a presence of the personnel. If the image data indicates a presence of the personnel, the fan(s) 108 may be controlled to operate at a certain speed, powered on, etc. Comparatively, if the image data indicates an absence of the personnel, the fan(s) 108 may be controlled to be powered off, reduced in speed, etc. For example, while the personnel retrieves the item(s) from an inventory, and exits a field of view of the camera(s) 1102, the fan(s) 108 may be powered down. As the personnel comes within the field of view, and the presence of the personnel is detected, the fan(s) 108 may be powered on.

The sensor(s) 142 may be disposed on the front 132 of the device 100, at the station 900, etc. In some instances, the sensor(s) 142 may be disposed on the base 104, such as the first structural member 222(1), the arm assembly 106, such as the shelf, beneath the base 104, etc. The sensor(s) 142 may be oriented towards the front 132, so as to detect a presence of a personnel in front of the device 100, for example. Any number and/or type of the sensor(s) 142 may be used. Moreover, the sensor(s) 142 may be disposed differently than shown. The sensor(s) 142 may also be disposed on the device 100 for determining the presence of the personnel at the device 100.

The mat 1106 may include presence sensor(s) (e.g., weight, contact, etc.) for detecting a presence of the personnel. When the personnel is standing on the mat 1106, for example, to load the item(s) into the container 102, the fan(s) 108 may be powered on. Alternatively, when the personnel is not standing on the mat 1106, the fan(s) 108 may be powered off.

The mobile device 152 may also be used to determine a location of the personnel relative to the device 100 for controlling the fan(s) 108.

The scanner 1104, the mobile device 152, etc. may be used for scanning, imaging, reading, etc. the item(s) to be loaded into the container 102. For example, a barcode, machine-readable identifier, etc. may be scanned by the scanner 1104, mobile device 152, etc. to determine the item(s) being loaded into the container 102 to control the fan(s) 108.

The device 100, the camera(s) 1102, the sensor(s) 142, the scanner 1104, the mobile device 152, and the mat 1106 may communicatively couple to one another via the one or more network(s) 146, which may be wired or wireless networks.

Figure 12A:
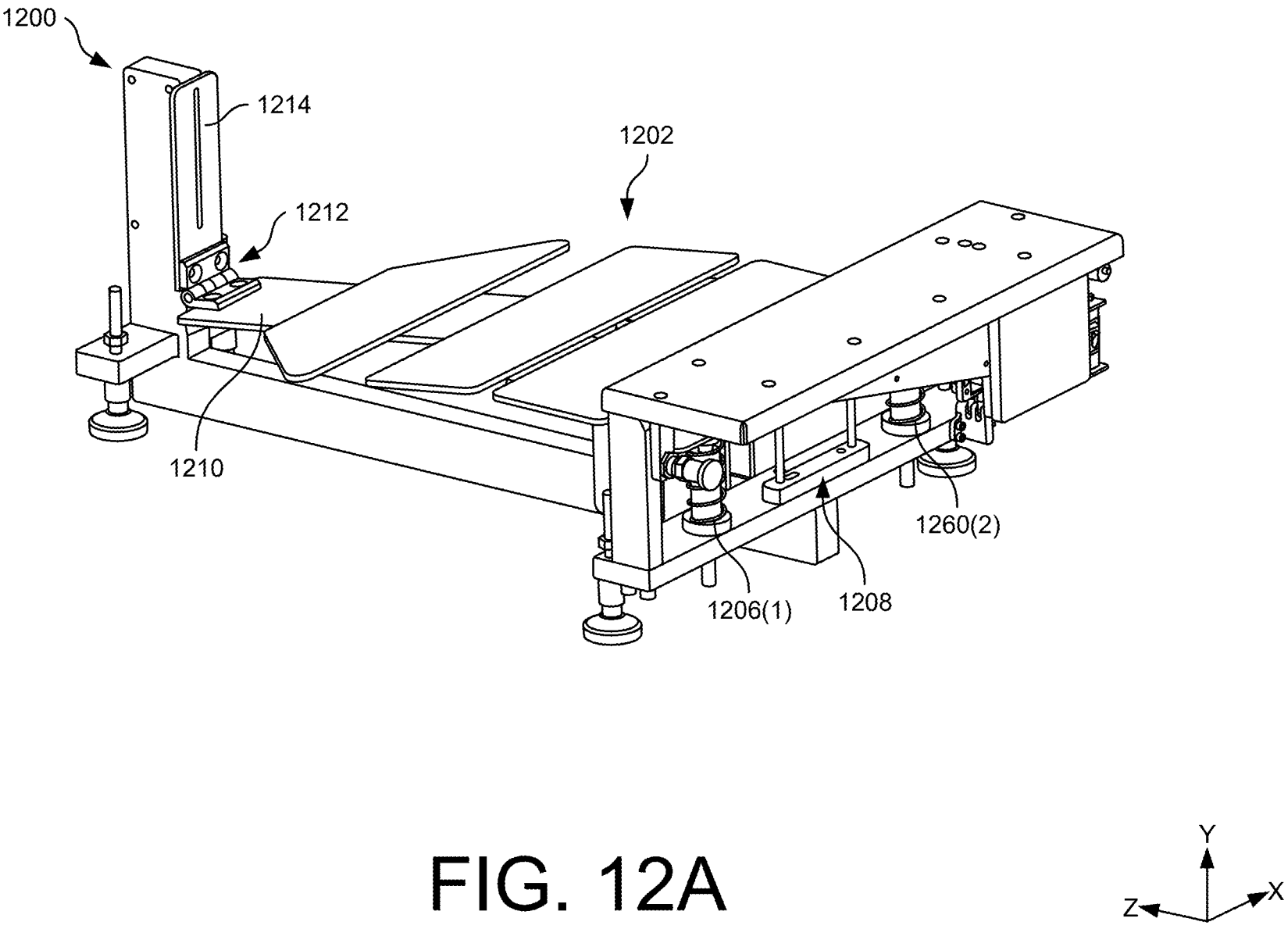
FIGS. 12A and 12B illustrate an alternate device used to expand a container for permitting the container to be conveniently loaded with item(s), according to examples of the present disclosure.
Figure 12B:
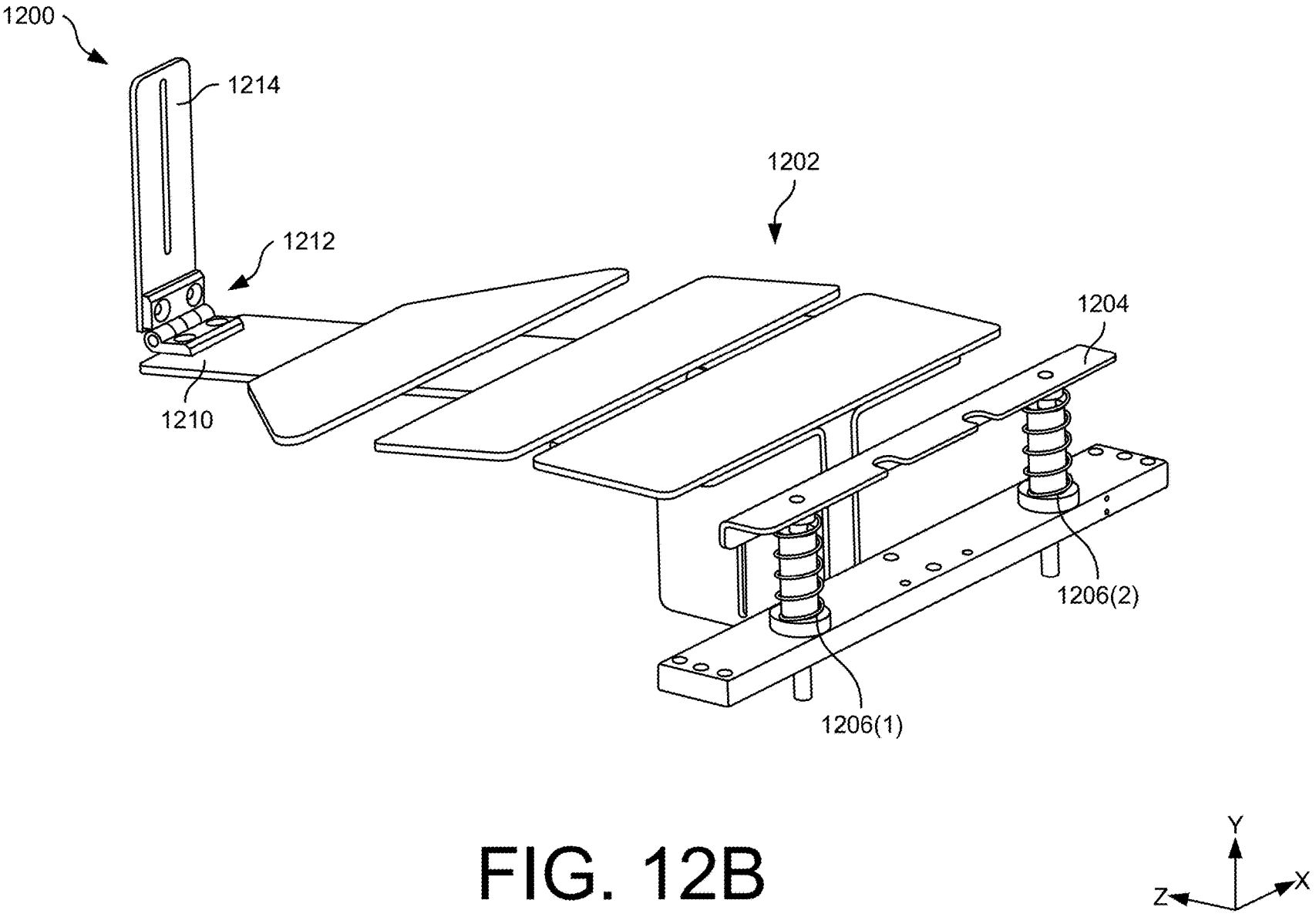

FIGS. 12A and 12B illustrate an alternative device 1200, according to examples of the present disclosure. In some instances, the device 1200 may be similar to the device 100 and/or the device 1000 as described above. However, in some instances, the device 1200 may not include the rail 134 along which the platform 126 translates. Instead, the containers 102 may be supported along or over one or more plates 1202. The containers 102, however, may be secured to a platform 1204 that is acted on by one or more biasing elements 1206, such as a first biasing element 1206(1) and a second biasing element 1206(2). The platform 1204 may be moved to a bottom-most position to be loaded with the containers 102 and thereafter the biasing elements 1206 may bias the platform 1204 to a top-most position as the containers 102 are loaded. A wicket 2108 at a front of the device 1200 may include posts that are disposed through the containers 102, which may maintain an alignment of the containers 102 on the device 1200. As the containers 102 are filled and removed from the device 1200, the biasing elements 1206 continue to act on the platform 1204 to raise the containers 102 into position.

As also shown, the plates 1202 may be coupled together via an arm 1210. The arm 1210 may be hingedly coupled, via a hinge 1212, to a bar 1214 that is coupled to a back of the device 1200. As the containers 102 are filled and removed from the device 1200, for example, the hinged coupling may permit the plates 1202 to raise, for example, to support the containers 102. In the embodiment in FIGS. 12A and 12B, the device 1200 includes the platform 1204, but the platform 1204 may not translate along the rail 134, for example, as the containers 102 are filled and removed. Similarly to the device 100 and the device 1000, however, the platform 1204 may be acted on by the biasing elements 1206.

Figure 13:
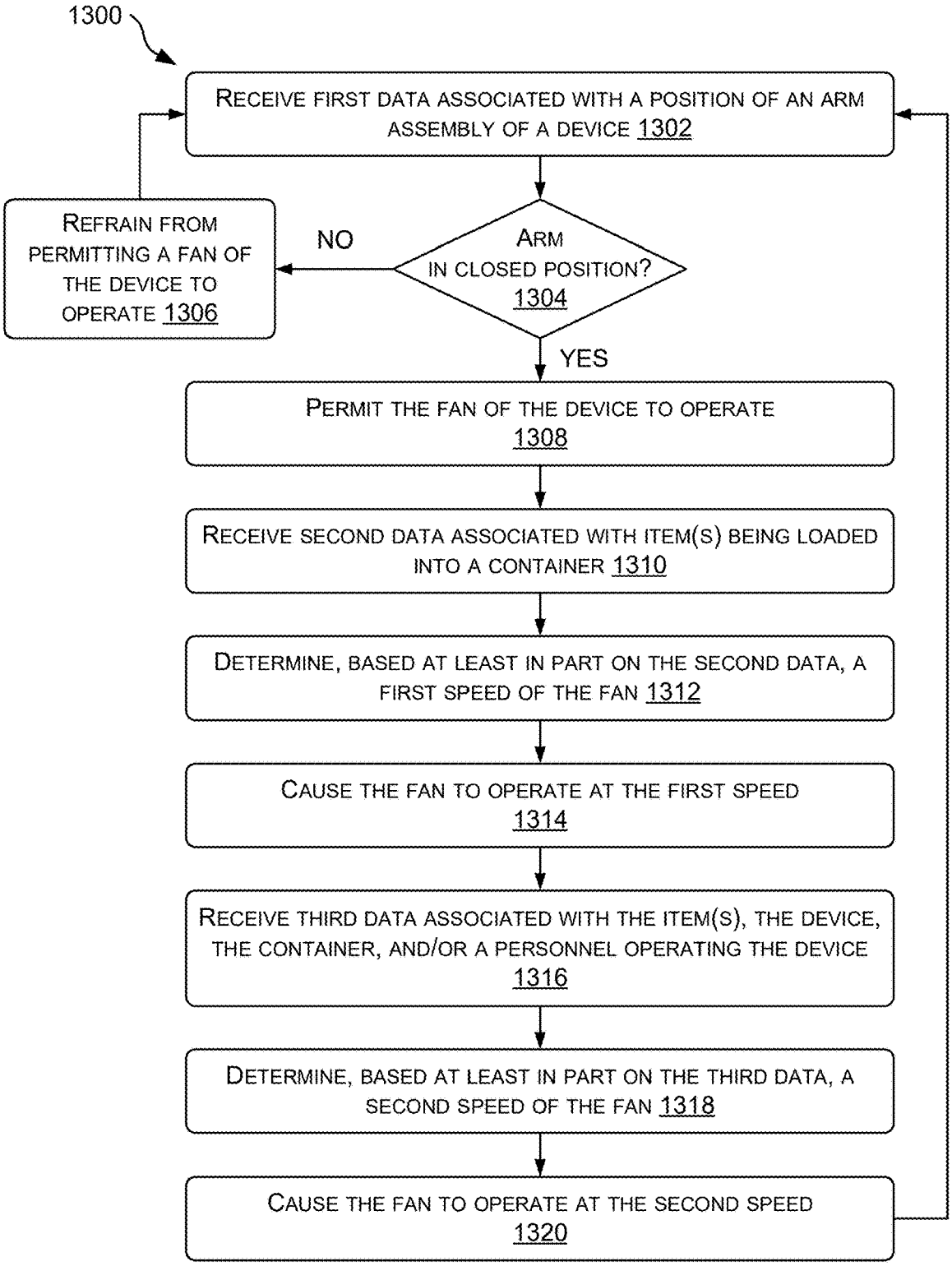
FIG. 13 illustrates an example process associated with expanding a container, according to examples of the present disclosure.

FIG. 13 illustrates example process 1300 (e.g., methods) related to expanding a container 102 to permit loading the container 102 with item(s), according to examples of the present disclosure. The process 1300 described herein are illustrated as collections of blocks in logical flow diagrams, which represent a sequence of operations, some or all of which may be implemented in hardware, software, or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation, unless specifically noted. Any number of the described blocks may be combined in any order and/or in parallel to implement the process 1300, or alternative processes, and not all of the blocks need be executed. For discussion purposes, the processes are described with reference to the environments, devices, architectures, diagrams, and systems described in the examples herein, such as those described with respect to FIGS. 1-12B, although the process 1300 may be implemented in a wide variety of other environments, architectures, and systems.

At 1302, the process 1300 may include receiving first data associated with a position of an arm assembly of a device. For example, the device 100 may receive sensor data 144 indicating a position of the arm assembly 106, such as whether the arm assembly 106 is in the open position or the closed position. In some instances, the sensor may include a contact sensor, proximity sensor, switch, etc. In some instances, the sensor data 144 may indicate whether the latch 230 is engaged with a receptacle, keep, etc.

At 1304, the process 1300 may include determining whether the arm assembly is in the closed position. For example, based at least in part on the sensor data 144, the device 100 may determine whether the arm assembly 106 is in the closed position. If the arm assembly 106 is in the open position, the process 1300 may follow the "NO" route and proceed to 1306, whereby the process 1300 may refrain from permitting a fan of the device to operate. From 1306, the process 1300 may loop to 1302 to continue to receive the sensor data 144 to determine whether the arm assembly 106 is in the closed position.

Alternatively, if the process 1300 determines that the arm assembly 106 is in the closed position, the process 1300 may follow the "YES" route and proceed to 1308, whereby the process 1300 may include permitting the fan to operate.

At 1310, the process 1300 may include receiving second data associated with item(s) being loaded int the container. In some instances, the second data may represent sensor data 144 generated by the sensor(s) 142 of the device 100, sensor(s) of other devices, such as the camera(s) 1102, etc. In some instances, the second data may be generated by the scanner 1104, for example, operated by personnel at the station 900. For example, as the personnel load the item(s) into the container 102, the personnel may scan the item(s).

At 1312, the process 1300 may include determining, based at least in part on the second data, a first speed of the fan. For example, the sensor data 144 may be used to determine the item(s) being loaded into the container 102, and based at least in part on the item(s), the fan(s) 108 may be operated accordingly. For example, the sensor data 144 may be used to determine characteristic(s) of the item(s), such as a size, shape, weight, etc. of the item(s). Based at least in part on the characteristic(s), the speed of the fan(s) 108 may be determined. For example, if the item(s) is large in size, the speed of the fan(s) 108 may be increased to expand the container 102 to permit the item(s) to be conveniently loaded into to the container 102. Comparatively, if the item(s) is smaller in size, the speed of the fan(s) 108 may be reduced, as the container 102 may not need to be expanded as much to conveniently load the item(s) into the container 102 (in comparison to a larger item).

At 1314, the process 1300 may include causing the fan(s) to operate at the first speed. For example, the device 100 may control the fan(s) 108 to operate the fan(s) 108 at the first speed. Although described as controlling the speed of the fan(s) 108, other setting(s) 140 may be determined and the fan(s) 108 may be controlled to such setting(s) 140. The fan(s) 108 may blow air into the container 102 before, during, and/or after the item(s) are loaded.

At 1316, the process 1300 may include receiving third data associated with the item(s), the device, the container, and/or the personnel operating the device. The third data may be sensor data 144 generated by the sensor(s) 142. In some instances, the sensor data 144 may indicate additional item(s) being loaded into the container 102, such as the characteristic(s) of the additional item(s). The third data may also represent sensor data 144 generated by flow rate sensor(s) of the device 100 that measure an airflow exiting the cavity 122 of the container 102, a speed of the air exiting the cavity 122, etc. The third data may represent sensor data 144 associated with whether the personnel is present at the station 900 (e.g., standing on the mat 1106), actively loading item(s) into the container 102, etc. The sensor data 144 may also indicate a position of the arm assembly 106. Any combination of sensor data 144 generated by the sensor(s) 142 may be received.

At 1318, the process 1300 may include determining, based at least in prat on the third data, a second speed of the fan. For example, based at least in part on the sensor data 144, the device 100 may determine a second speed of the fan(s) 108. The second speed may be less than, greater than, or equal to the first speed. As examples of controlling the speed of the fan(s) 108, after a first item is loaded into the container 102, the first item may at least partially keep the container 102 expanded while a second item is loaded into the container 102. In such instances, the speed of the fan(s) 108 may be reduced. Alternatively, if the second item is larger in size than the first item, the speed of the fan(s) 108 may be increased to expand the container 102 to load the second item. Moreover, while the personnel retrieves item(s) for an inventory, the fan(s) 108 may be reduced in speed and/or powered off. When the personnel stands on the mat 1106, is within a certain proximity of the device 100, the fan(s) 108 may be powered back on. As another example, if the personnel is removing the container 102 from the platform 126, the fan(s) 108 may be powered off until the container 102 is removed and a new container is set to be loaded with additional item(s).

At 1320, the process 1300 may include causing the fan(s) to operate at the second speed. For example, after determining the second speed, the device 100 may control the fan(s) 108 to operate at the second speed. From 1320, the process 1300 may loop to 1302.

While various examples and embodiments are described individually herein, the examples and embodiments may be combined, rearranged, and modified to arrive at other variations within the scope of this disclosure.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A device configured to expand a container for loading the container with one or more items, the device comprising:

a base;

rail;

a platform configured to receive the container, the platform being configured to translate along the rail between a top-most position and a bottom-most position;

a biasing element coupled to the base and the platform for translating the platform from the bottom-most position to the top-most position; and an arm assembly pivotably coupled to the base, the arm assembly being configured to transition between a first position in which the container is loaded onto the platform, and a second position in which the container is secured to the platform, the arm assembly including:

a fan, and a manifold having an inlet fluidly connected to the fan and an outlet with one or more ducts, wherein the manifold routes air into a cavity of the container to at least partially expand the container for loading the container with the one or more items.

2. The device of claim 1, wherein:

the device further includes a wicket having a first post and a second post;

the container includes a first hole and a second hole, the first hole being disposed over the first post and the second hole being disposed over the second post; and the container is removed from the first post via a first portion of the container adjacent to the first hole being torn, and is removed from the second post via a second portion of the container adjacent to the second hole being torn.

3. The device of claim 1, wherein:

the device further includes a first stop and a second stop;

the platform includes a first channel and a second channel; and the first stop is configured to engage with the first channel and the second stop engages with the second channel to prevent the biasing element transitioning the platform from the bottom-most position to the top-most position.

4. The device of claim 1, further comprising:

a sensor;

one or more processors, and one or more computer-readable media storing instructions that, when executed, cause the one or more processors to perform operations including:

receiving, from the sensor, sensor data associated with the arm assembly, determining, based on the sensor data, that the arm assembly is in the second position, and based on the arm assembly being in the second position, permitting the fan to operate.

5. A device comprising:

a base;

a platform configured to receive containers;

a fan;

an arm assembly including a manifold configured to direct air output from the fan into the containers, the arm assembly being transitionable between a first position in which the containers are secured on the platform, and a second position in which the containers are configured to be loaded on the platform; and a biasing element coupled to the base and the platform, the biasing element configured to bias the containers in a direction towards the air output from the fan.

6. The device of claim 5, wherein the manifold includes:

an inlet fluidly connected to the fan; and an outlet configured to direct the air into the containers, the outlet including a plurality of ducts that direct the air into the containers.

7. The device of claim 5, wherein:

the platform includes a bottom-most position and top-most position;

in the bottom-most position, the containers are configured to be loaded onto the platform; and the biasing element is configured to bias the platform from the bottom-most position to the top-most position.

8. The device of claim 7, wherein:

the platform includes a channel;

a stop engages with the channel in the bottom-most position to retain the platform in the bottom-most position to prevent the biasing element biasing the platform from the bottom-most position to the top-most position; and the stop disengages with the channel in the bottom-most position to permit the biasing element to bias the platform from the bottom-most position to the top-most position.

9. The device of claim 5, further comprising:

a sensor;

one or more processors, and one or more computer-readable media storing instructions that, when executed, cause the one or more processors to perform operations including:

receiving, from the sensor, sensor data associated with the arm assembly, determining, based at least in part on the sensor data, that the arm assembly is in the first position, and based at least in part on the arm assembly being in the first position, permitting the fan to operate.

10. The device of claim 5, further comprising:

one or more processors, and one or more computer-readable media storing instructions that, when executed, cause the one or more processors to perform operations including:

determining an item to be loaded into a container of the containers, determining, based at least in part on the item, a speed of the fan, and causing the fan to operate at the speed.

11. The device of claim 10, the operations further including:

determining a second item to be loaded into the container;

determining, based at least in part on the second item, a second speed of the fan that is different than the speed; and causing the fan to operate at the second speed.

12. The device of claim 10, further comprising:

one or more processors, and one or more computer-readable media storing instructions that, when executed, cause the one or more processors to perform operations including:

receiving, from at least one of a sensor of the device or a second device communicatively coupled to the device, data associated with a presence of a personnel loading an item into a container of the containers, and causing, based at least in part on the data, the fan to operate.

13. The device of claim 12, wherein causing the fan to operate comprises causing the fan to operate at a first setting, the operations further including:

receiving, from the at least one of the sensor of the device or the second device, second data associated with an absence of the personnel; and causing, based at least in part on the second data, at least one of:

the fan to operate at a second setting different than the first setting, or the fan to power off.

14. The device of claim 5, wherein:

the platform includes a central vertical plane;

the biasing element includes a central axis; and the biasing element is disposed at an acute angle relative to the central vertical plane.

15. A device comprising:

a platform configured to receive a plurality of containers;

a manifold configured to direct air into a container of the plurality of containers, wherein directing the air into the container causes the container to at least partially expand to permit the container to be loaded with one or more items;

a biasing element configured to bias the platform in a direction toward the air being directed into the container; and an arm assembly configured to move between a first position and a second position, wherein in the first position, the plurality of containers is secured between the arm assembly and the platform, and in the second position, the plurality of containers is configured to be loaded onto the platform.

16. The device of claim 15, wherein the air is directed into a top-most container of the plurality of containers.

17. The device of claim 15, further comprising:

a sensor;

one or more processors, and one or more computer-readable media storing instructions that, when executed, cause the one or more processors to perform operations including:

receiving, from the sensor, sensor data associated with the arm assembly, determining, based at least in part on the sensor data, that the arm assembly is in the first position, and based at least in part on the arm assembly being in the first position, permitting the air to be directed into the container.

18. The device of claim 15, further comprising:

one or more processors, and one or more computer-readable media storing instructions that, when executed, cause the one or more processors to perform operations including:

receiving first data associated with a first item of the one or more items to be loaded into the container, determining, based at least in part on the first data, a first rate at which the air is directed into the container, causing the air to be supplied at the first rate, receiving second data associated with a second item of the one or more items to be loaded into the container, determining, based at least in part on the second data, a second rate at which the air is directed into the container, and causing the air to be supplied at the second rate.

19. The device of claim 15, wherein the manifold includes at least two ducts for directing the air into the container.

* * * * *